US011618645B2

(12) United States Patent
Yoneyama et al.

(10) Patent No.: US 11,618,645 B2
(45) Date of Patent: Apr. 4, 2023

(54) RECORDING MATERIAL PROCESSING APPARATUS AND IMAGE FORMING SYSTEM

(71) Applicant: FUJIFILM BUSINESS INNOVATION CORP., Tokyo (JP)

(72) Inventors: Takeshi Yoneyama, Yokohama (JP); Shiro Ohashi, Yokohama (JP); Naoto Hamabata, Yokohama (JP); Taiki Watanabe, Yokohama (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 185 days.

(21) Appl. No.: 16/985,614

(22) Filed: Aug. 5, 2020

(65) Prior Publication Data

US 2021/0300703 A1 Sep. 30, 2021

(30) Foreign Application Priority Data

Mar. 27, 2020 (JP) ..... JP2020-057593
Mar. 27, 2020 (JP) ..... JP2020-057594

(51) Int. Cl.
*B65H 31/34* (2006.01)
*B65H 9/16* (2006.01)
(Continued)

(52) U.S. Cl.
CPC ..... *B65H 31/34* (2013.01); *B41J 11/0055* (2013.01); *B65H 5/062* (2013.01);
(Continued)

(58) Field of Classification Search
CPC ..... B65H 9/16; B65H 29/14; B65H 31/00; B65H 31/20; B65H 31/34; B65H 2404/70;
(Continued)

(56) References Cited

U.S. PATENT DOCUMENTS 4,657,239 A * 4/1987 Ikesue ..... B65H 9/101 271/227
8,246,034 B2 * 8/2012 Tsuchiya ..... B65H 31/3018 270/58.11
8,985,571 B2 * 3/2015 Ueda ..... B65H 1/04 271/248
2002/0079642 A1 6/2002 Tamura et al.
2005/0189706 A1 9/2005 Tamura et al.
2006/0082044 A1 * 4/2006 Aida ..... B65H 1/04 271/145
2013/0032988 A1 2/2013 Miyake et al.
2013/0032991 A1 2/2013 Ando et al.
2013/0032992 A1 2/2013 Sato et al.
(Continued)

FOREIGN PATENT DOCUMENTS

JP 2001-240295 A 9/2001
JP 3857012 B2 12/2006
(Continued)

*Primary Examiner* — Prasad V Gokhale
(74) *Attorney, Agent, or Firm* — Oliff PLC

(57) ABSTRACT

Provided is a recording material processing apparatus including: a recording material support portion configured to support a recording material loaded thereon from below; a contact member disposed on a side of the recording material loaded on the recording material support portion and configured to be pushed by an edge portion of the recording material, the contact member being configured to move to a side opposite to the side of the recording material; an elastic member configured to receive a load from the contact member pushed by the edge portion of the recording material; and a member support portion disposed without contacting the recording material loaded on the recording material support portion and configured to support the contact member.

18 Claims, 20 Drawing Sheets

(51) Int. Cl.

| | |
|---|---|
| ***B65H 5/06*** | (2006.01) |
| ***B41J 11/00*** | (2006.01) |
| ***G03G 15/00*** | (2006.01) |
| ***B65H 31/20*** | (2006.01) |

(52) U.S. Cl.
CPC ..... *B65H 9/16* (2013.01); *B65H 31/20* (2013.01); *G03G 15/6567* (2013.01); *B65H 2405/114* (2013.01); *B65H 2511/12* (2013.01)

(58) Field of Classification Search
CPC ..... B65H 2404/721; B65H 2404/722; B65H 2404/725; B65H 2404/74; B65H 2404/7412; B65H 2404/7414; B65H 2404/742; B65H 2405/114; B65H 2405/1144; B65H 2511/12; B41J 11/0055
USPC ..... 271/248, 253, 255
See application file for complete search history.

(56) References Cited

U.S. PATENT DOCUMENTS

| | | | | |
|---|---|---|---|---|
| 2013/0214483 | A1* | 8/2013 | Hirahara ..... | B65H 1/00 271/147 |
| 2013/0285313 | A1 | 10/2013 | Iwata | |
| 2014/0197590 | A1 | 7/2014 | Miyake et al. | |
| 2020/0307275 | A1* | 10/2020 | Yonemitsu ..... | B65H 5/062 |

FOREIGN PATENT DOCUMENTS

| | | | |
|---|---|---|---|
| JP | 3973836 | B2 | 9/2007 |
| JP | 4593515 | B2 | 12/2010 |
| JP | 4598715 | B2 | 12/2010 |
| JP | 4891422 | B2 | 3/2012 |
| JP | 5511884 | B2 | 6/2014 |
| JP | 5825914 | B2 | 12/2015 |
| JP | 5847480 | B2 | 1/2016 |
| JP | 5921108 | B2 | 5/2016 |

* cited by examiner

RECORDING MATERIAL PROCESSING APPARATUS AND IMAGE FORMING SYSTEM

CROSS-REFERENCE TO RELATED APPLICATIONS

This application is based on and claims priorities under 35 USC 119 from Japanese Patent Application No. 2020-057593 filed on Mar. 27, 2020, and Japanese Patent Application No. 2020-057594 filed on Mar. 27, 2020.

BACKGROUND

Technical Field

The present invention relates to a recording material processing apparatus and an image forming system.

Related Art

Patent Literature 1 discloses a processing of aligning positions of end faces by bringing alignment members into or out of contact with end faces of a sheet-shaped medium parallel to a discharge direction of the sheet-shaped medium after the sheet-shaped medium discharged from a discharge unit is completely loaded on a tray.

CITATION LIST

Patent Literature

Patent Literature 1: JP-A-2001-240295

SUMMARY

While aligning a recording material, a contact member pushed by an edge portion of the recording material is provided, and the recording materials are aligned with the contact member pushed by the recording material.

However, when aligning the recording materials, a load is applied to each recording material. When the load is large, the recording material may be wavy and deformed, or when the load is released, the recording material may bounce and the alignment may be disturbed. Further, when a load that acts on the recording material is large, an edge portion of the recording material may be broken.

One Aspect of non-limiting embodiments of the present disclosure relates to reduce a load that acts on a recording material when aligning the recording material as compared with a case where a contact member pushed by a recording material does not move.

In an apparatus that processes a recording material, a position in an extending direction of the recording material may not be aligned. Further, a recording material may bulge in a thickness direction of the recording material. As a method corresponding thereto, in addition to a mechanism that aligns a position in an extending direction of the recording material, it is conceivable to provide a mechanism for applying a load that acts in a thickness direction of the recording material to the recording material. However, by separately configuring mechanisms that act on the recording material, the configuration becomes complicated, such as increasing the number of parts, or a need to control an order of the mechanisms that act on the recording material.

Another aspect of non-limiting embodiments of the present disclosure relate to prevent a configuration required for processing a recording material from becoming complicated, as compared with a case where a mechanism for aligning a position in an extending direction of a recording material and a mechanism for applying a load that acts in a thickness direction of the recording material to the recording material are separately provided.

Aspects of certain non-limiting embodiments of the present disclosure address the advantages and/or other advantages not described above. However, aspects of the non-limiting embodiments are not required to address the above advantages, and aspects of the non-limiting embodiments of the present disclosure may not address advantages described above.

According to an aspect of the present disclosure, there is provided a recording material processing apparatus including: a recording material support portion configured to support a recording material loaded thereon from below; a contact member disposed on a side of the recording material loaded on the recording material support portion and configured to be pushed by an edge portion of the recording material, the contact member being configured to move to a side opposite to the side of the recording material; an elastic member configured to receive a load from the contact member pushed by the edge portion of the recording material; and a member support portion disposed without contacting the recording material loaded on the recording material support portion and configured to support the contact member.

BRIEF DESCRIPTION OF DRAWINGS

Exemplary embodiment(s) of the present invention will be described in detail based on the following figures, wherein:

FIG. 12A is a diagram showing another configuration example of a contact member and the like;

FIG. 12B is a diagram showing another configuration example of a contact member and the like;

DETAILED DESCRIPTION

First Exemplary Embodiment

Hereinafter, a first exemplary embodiment of the present invention will be described in detail with reference to the accompanying figures.

Figure 1:
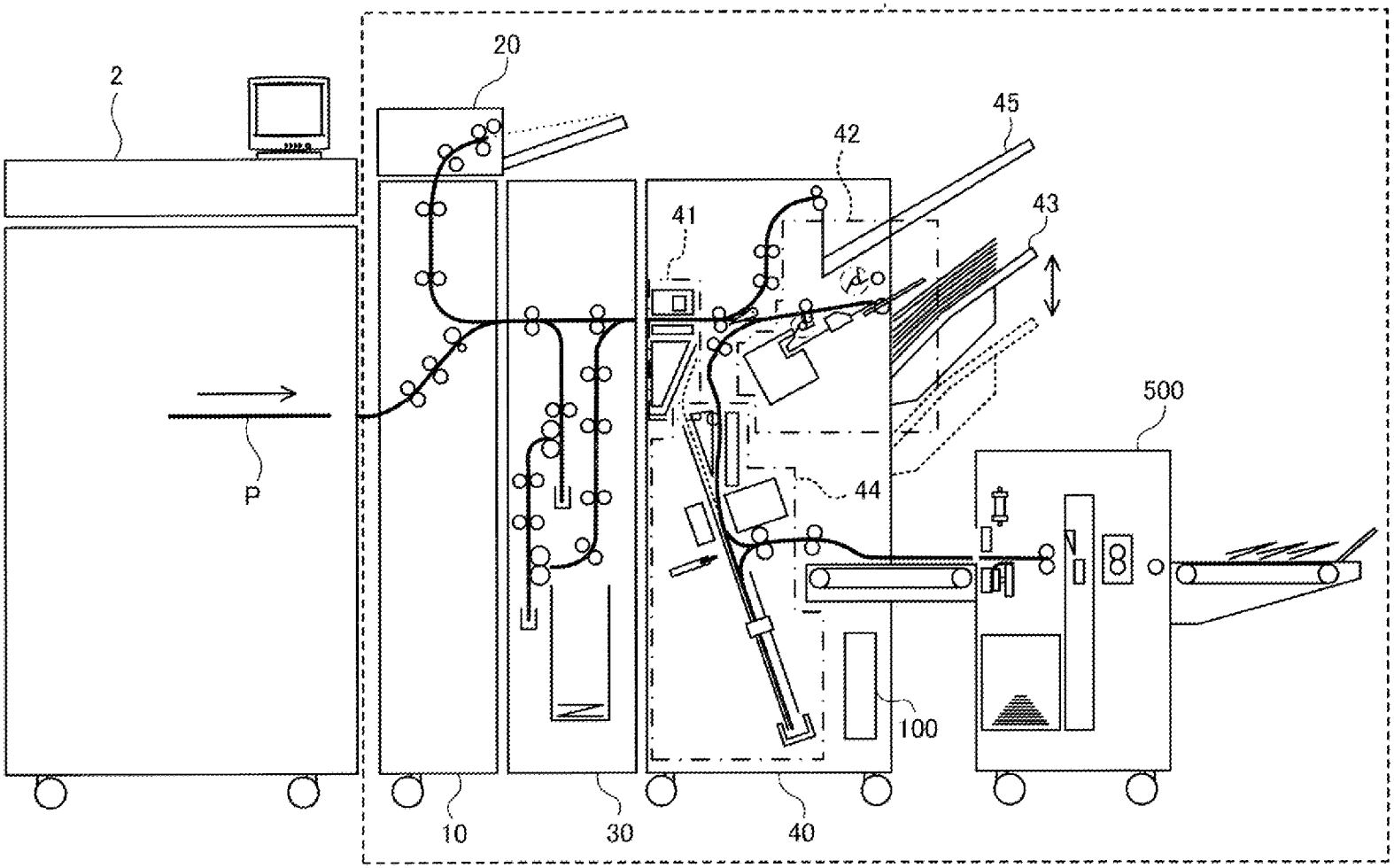
FIG. 1 is a diagram showing an overall configuration of an image forming system.

FIG. 1 is a diagram showing an overall configuration of an image forming system 1 according to the first exemplary embodiment.

The image forming system 1 shown in FIG. 1 includes an image forming apparatus 2 that forms an image on a sheet P that is an example of a recording material, and a sheet processing apparatus 3 that performs a predetermined processing on the sheet P on which an image is formed by the image forming apparatus 2.

Here, the image forming apparatus 2 uses an electrophotographic method or an inkjet method to form an image on the sheet P.

The sheet processing apparatus 3, which is an example of a recording material processing apparatus, is provided with a transport device 10 that transports the sheet P output from the image forming apparatus 2 to a downstream side, and an interleaving sheet supply device 20 that supplies an interleaving sheet such as a thick sheet or a window open sheet P to the sheet P transported by the transport device 10.

Further, the sheet processing apparatus 3 is provided with a folding device 30 that performs a folding processing such as inward three-folding (C-folding) and outward three-folding (Z-folding) on the sheet P transported from the transport device 10.

The sheet processing apparatus 3 is provided with a first post-processing device 40 that is provided on a downstream side of the folding device 30 and performs hole forming, end-binding, saddle binding, and the like on the sheet P.

In other words, the downstream side of the folding device 30 is provided with the first post-processing device 40 that performs a processing on a sheet bundle (an example of a recording material set) including one or more sheets P on which an image is formed by the image forming apparatus 2, or performs a processing on sheet P for each sheet P.

The sheet processing apparatus 3 is provided with a second post-processing device 500 that is provided on a downstream side of the first post-processing device 40 and further performs a processing on a center-folded or saddle-bound sheet bundle.

Further, the sheet processing apparatus 3 is provided with a controller 100 that is configured with a central processing unit (CPU), which executes a program, and controls functional units of the sheet processing apparatus 3.

The first post-processing device 40 is provided with a punching unit 41 that forms holes (punching) on the sheet P and an end-binding stapler unit 42 that binds an end of the sheet bundle.

Further, a first loading unit 43 on which a sheet P that has passed through the end-binding stapler unit 42 is loaded, and a second loading unit 45 on which a sheet P not processed by the first post-processing device 40 or a sheet P that has only been subjected to hole forming is loaded are provided. The first loading unit 43 and the second loading unit 45 are opened to an outside of the apparatus, and an operator manually removes the sheet P loaded on the first loading unit 43 or the second loading unit 45.

Furthermore, the first post-processing device 40 is provided with a saddle binding unit 44 that performs center folding/saddle binding on the sheet bundle so as to produce a double-page spread booklet.

Figure 2:
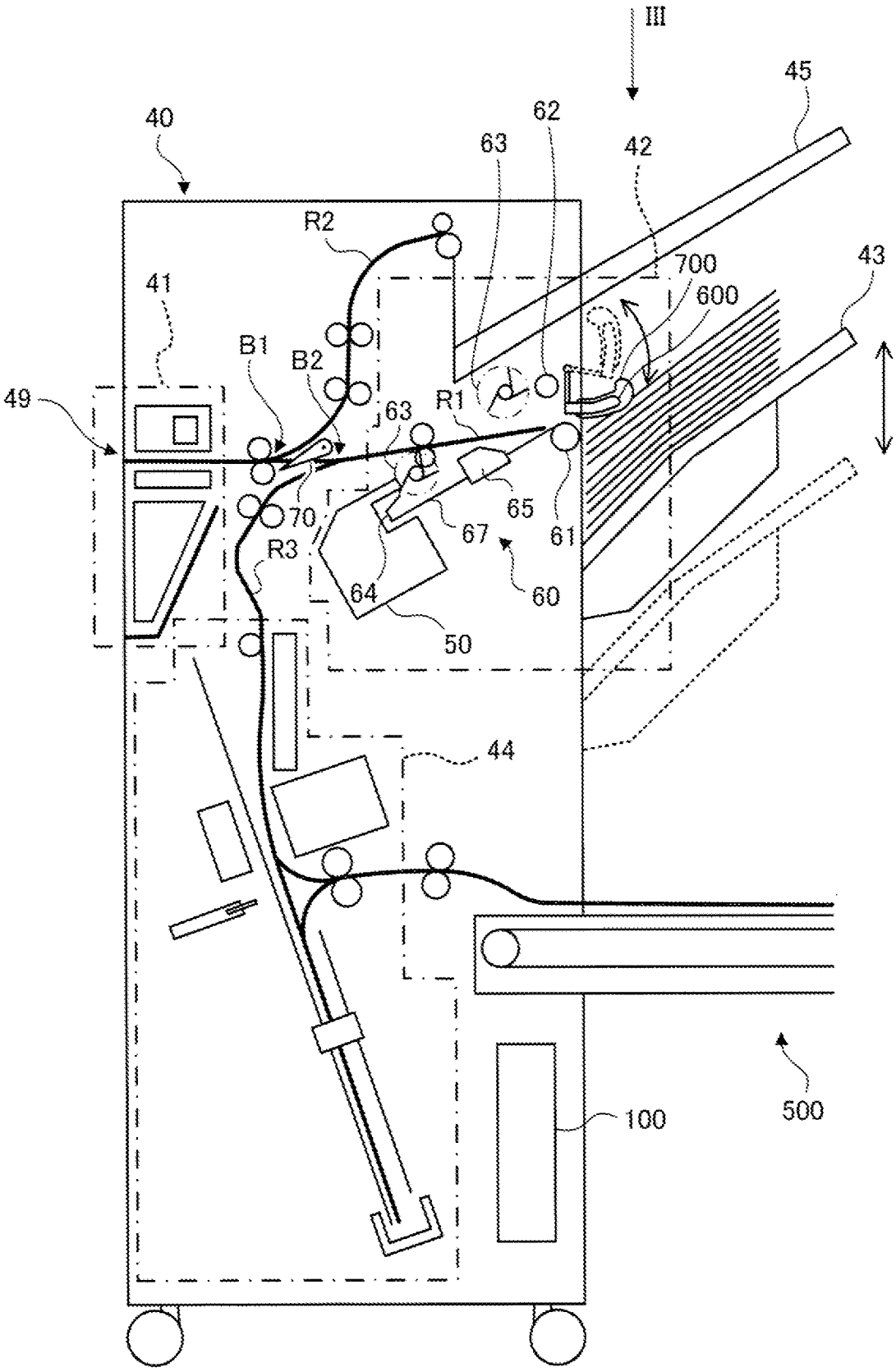
FIG. 2 is a diagram illustrating a configuration of a first post-processing device.

FIG. 2 is a diagram illustrating a configuration of the first post-processing device 40.

The first post-processing device 40 is provided with a receiving port 49 that receives the sheet P transported from the folding device 30.

The punching unit 41 is provided right behind the receiving port 49. The punching unit 41 forms holes (punching) such as two holes or four holes on the sheet P transported to the first post-processing device 40.

A first sheet transport path R1 is provided which extends from the receiving port 49 to the end-binding stapler unit 42 and is used to transport the sheet P received at the receiving port 49 to the edge-binding stapler unit 42.

Further, a first branch portion B1 is provided with a second sheet transport path R2 that branches from the first sheet transport path R1 and is used to transport the sheet P to the second loading unit 45.

A second branch portion B2 is provided with a third sheet transport path R3 that branches from the first sheet transport path R1 and is used to transport the sheet P to the saddle binding unit 44.

Further, a switching gate 70 is provided which switches (sets) a transport destination of the sheet P to any one of the first sheet transport path R1 to the third sheet transport path R3.

The end-binding stapler unit 42 is provided with a sheet accumulation unit 60 that accumulates only a necessary number of sheets P to generate a sheet bundle.

The sheet accumulation unit 60 is provided with a support plate 67 that is disposed to be inclined with respect to a horizontal direction and supports the transported sheet P from below. In the exemplary embodiment, the sheet bundle is generated on the support plate 67.

The end-binding stapler unit 42 is provided with a binding processing device 50 that performs binding (end binding) on an end portion of the sheet bundle generated by the sheet accumulation unit 60.

Further, the end-binding stapler unit 42 is provided with a discharge roller 61 that is driven to rotate and feeds the sheet bundle generated by the sheet accumulation unit 60 to the first loading unit 43 provided outside the apparatus.

Furthermore, a movable roller 62 is provided which is movable to a position retracted from the discharge roller 61 and a position in pressure contact with the discharge roller 61.

Here, when a processing by the end-binding stapler unit 42 is performed, first, the transported sheet P is received at the receiving port 49.

Thereafter, the sheet P is transported along the first sheet transport path R1 and reaches the end-binding stapler unit 42.

Then, the sheet P is transported to an upper side of the support plate 67 and then drops onto the support plate 67. Further, the sheet P is supported from below by the support plate 67, and is slidably moved on the support plate 67 by the inclination and a rotation member 63 given to the support plate 67.

Thereafter, the sheet P pushes an end guide 64 attached to an end portion of the support plate 67. In other words, in the exemplary embodiment, the end guide 64 that extends upward in the figure is provided on the end portion of the support plate 67, and the sheet P moved on the support plate 67 pushes the end guide 64.

Accordingly, in the exemplary embodiment, movement of the sheet P is stopped.

Thereafter, the operation is performed each time the sheet P is transported from an upstream side, and the sheet bundle in which the sheets P are aligned is generated on the support plate 67.

In the exemplary embodiment, a sheet width position alignment member 65 that aligns a position of the sheet bundle in a width direction is further provided.

In the exemplary embodiment, each time the sheet P is supplied onto the support plate 67, an end portion (side portion) of the sheet P in a width direction is pushed by the sheet width position alignment member 65, and positions of the sheets P (sheet bundle) in the width direction are also aligned.

When a predetermined number of sheets P are loaded on the support plate 67, the binding processing device 50 performs binding on the end portion of the sheet bundle.

Thereafter, in the exemplary embodiment, the movable roller 62 is advanced toward the discharge roller 61, and the sheet bundle is nipped by the movable roller 62 and the discharge roller 61. Thereafter, the discharge roller 61 is driven to rotate, and the sheet bundle is transported to the first loading unit 43.

The binding processing device 50 is provided so as to be movable toward a rear side and a front side of a paper surface in the figure. In the exemplary embodiment, a binding processing for the sheet P may be performed at a plurality of locations.

Further, the binding processing may not be performed by the binding processing device 50. In this case, a sheet P in a state where the binding processing is not performed is sent from the sheet accumulation unit 60 to the first loading unit 43.

Figure 3:
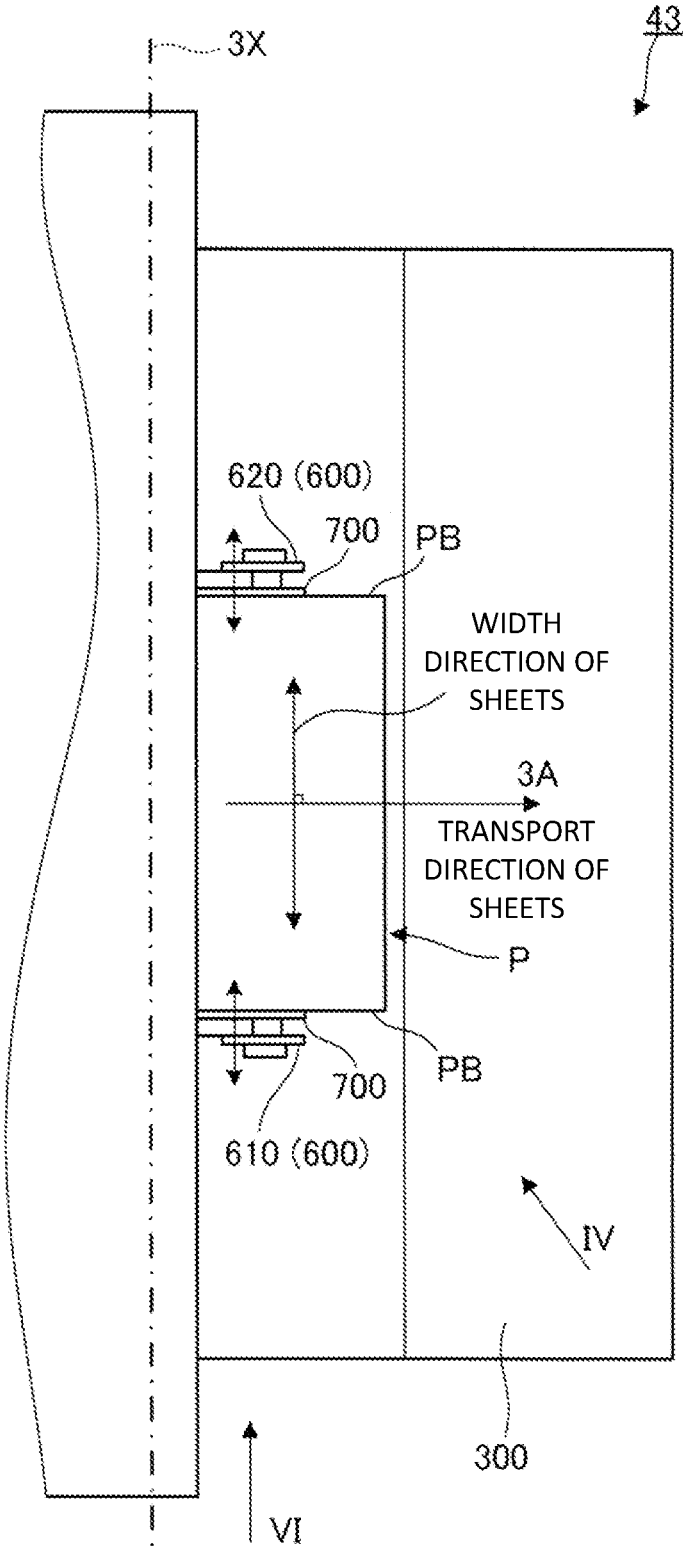
FIG. 3 is a diagram when a first loading unit is viewed from a direction indicated by an arrow III in FIG. 2.

FIG. 3 is a diagram when the first loading unit 43 is viewed from a direction indicated by an arrow III in FIG. 2.

The first loading unit 43 is provided with a support portion 300 that is an example of a recording material support portion. In the exemplary embodiment, loaded sheets P are placed on the support portion 300. The sheets P are supported by the support portion 300 from below. Further, the support portion 300 is inclined with respect to a horizontal direction.

Furthermore, the first loading unit 43 is provided with an advancing member 600 that advances from sides of the sheets P supported by the support portion 300 to the sheets P.

Here, in the exemplary embodiment, a first advancing member 610 and a second advancing member 620 are provided as the advancing member 600.

The first advancing member 610 is advanced from one side of the sheets P to the sheets P, and the second advancing member 620 is advanced from the other side of the sheets P to the sheets P.

Figure 5:
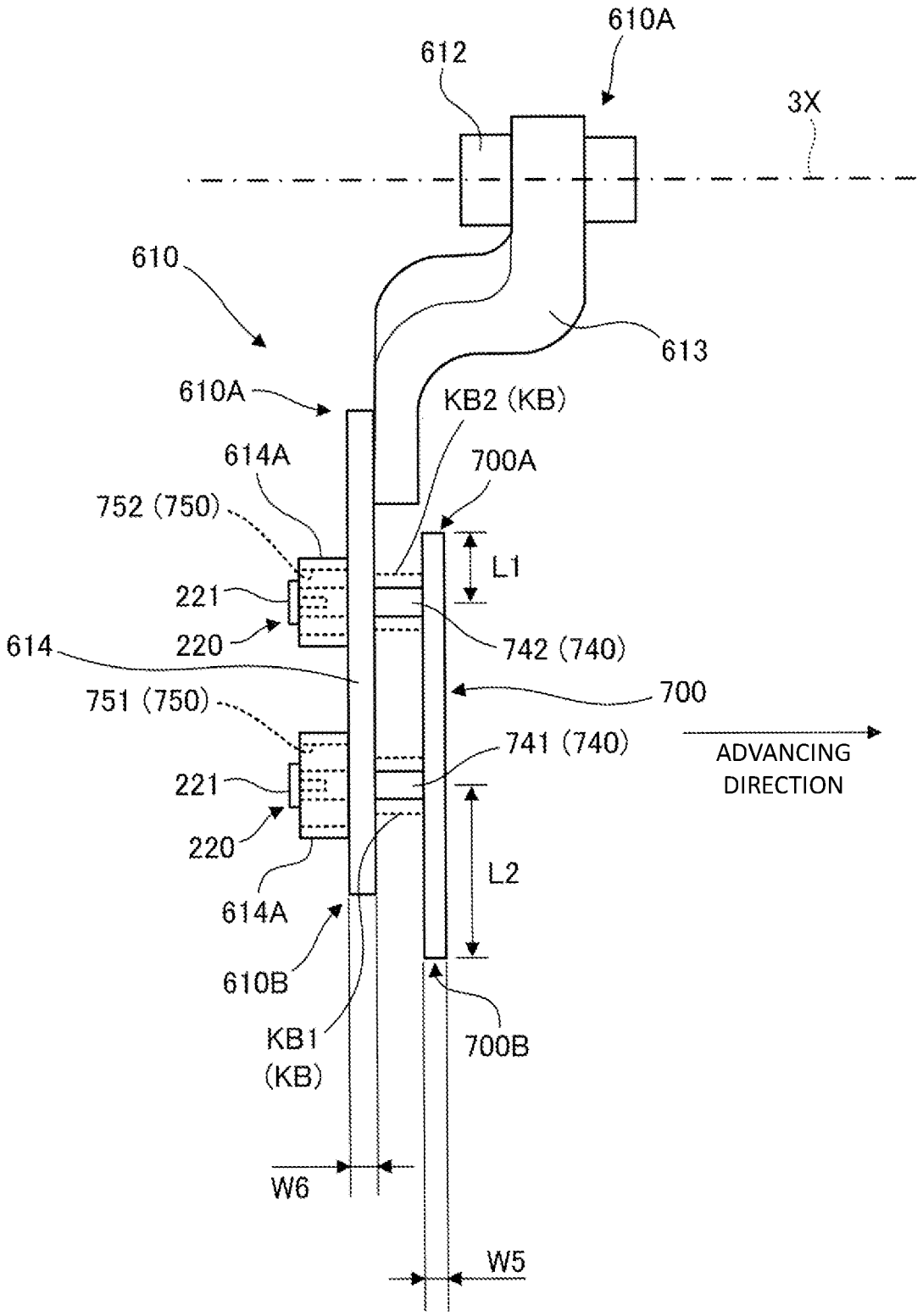
FIG. 5 is a diagram when the first advancing member and a contact member are viewed from a direction indicated by an arrow V in FIG. 4.

As shown in FIG. 5, the first advancing member 610 includes a rotation shaft 612, an arm portion 613 rotated around the rotation shaft 612, and an advancing portion 614 that advances from a side of the sheets P to the sheets P when the arm portion 613 is rotated and positioned below. Further, in the exemplary embodiment, a side of the advancing portion 614 close to the rotation shaft 612 is set as a rotation shaft 610A side, and a tip end side is set as a tip end 610B side.

In other words, each of the first advancing member 610 and the second advancing member 620 is moved in a direction orthogonal to a transport direction of the sheets P (width direction of the sheets P) so as to advance from a side of the sheets P to the sheets P.

Here, when loaded on the first loading unit 43, the sheets P are transported in a direction indicated by an arrow 3A in FIG. 3.

In the exemplary embodiment, each of the first advancing member 610 and the second advancing member 620 is moved in a direction orthogonal to the transport direction.

In other words, in the exemplary embodiment, each of the first advancing member 610 and the second advancing member 620 is moved in a direction intersecting a vertical direction and is advanced from a side of the sheets P to the sheets P.

Further, in the exemplary embodiment, contact members 700 in contact with the sheets P are attached to the first advancing member 610 and the second advancing member 620, respectively.

The contact members 700 are attached to a portion of the first advancing member 610 positioned on a sheet P side and a portion of the second advancing member 620 positioned on the sheet P side, and are in contact with edge portions PB of the sheets P as the first advancing member 610 and the second advancing member 620 are advanced to the sheets P.

In other words, the contact members 700 are provided closer to the sheet P side as compared with the advancing member 600, and are in contact with the edge portions PB of the sheets P as the first advancing member 610 and the second advancing member 620 are advanced to the sheets P.

Further, in the exemplary embodiment, as described later, each of the contact members 700 may be moved in a direction opposite to an advancing direction of the first advancing member 610 or an advancing direction of the second advancing member 620. Further, in the exemplary embodiment, the contact members 700 are advanced to the sheets P in a direction perpendicular to a vertical direction, and are moved toward the first advancing member 610 and the second advancing member 620 arranged on the side of the sheets P after being in contact with the sheets P. Surfaces of the first advancing member 610 and the second advancing member 620 at the same position in a direction perpendicular to a vertical direction of the sheets P receive an impact of the contact members 700 via coil springs KB (see FIG. 5).

Figure 4:
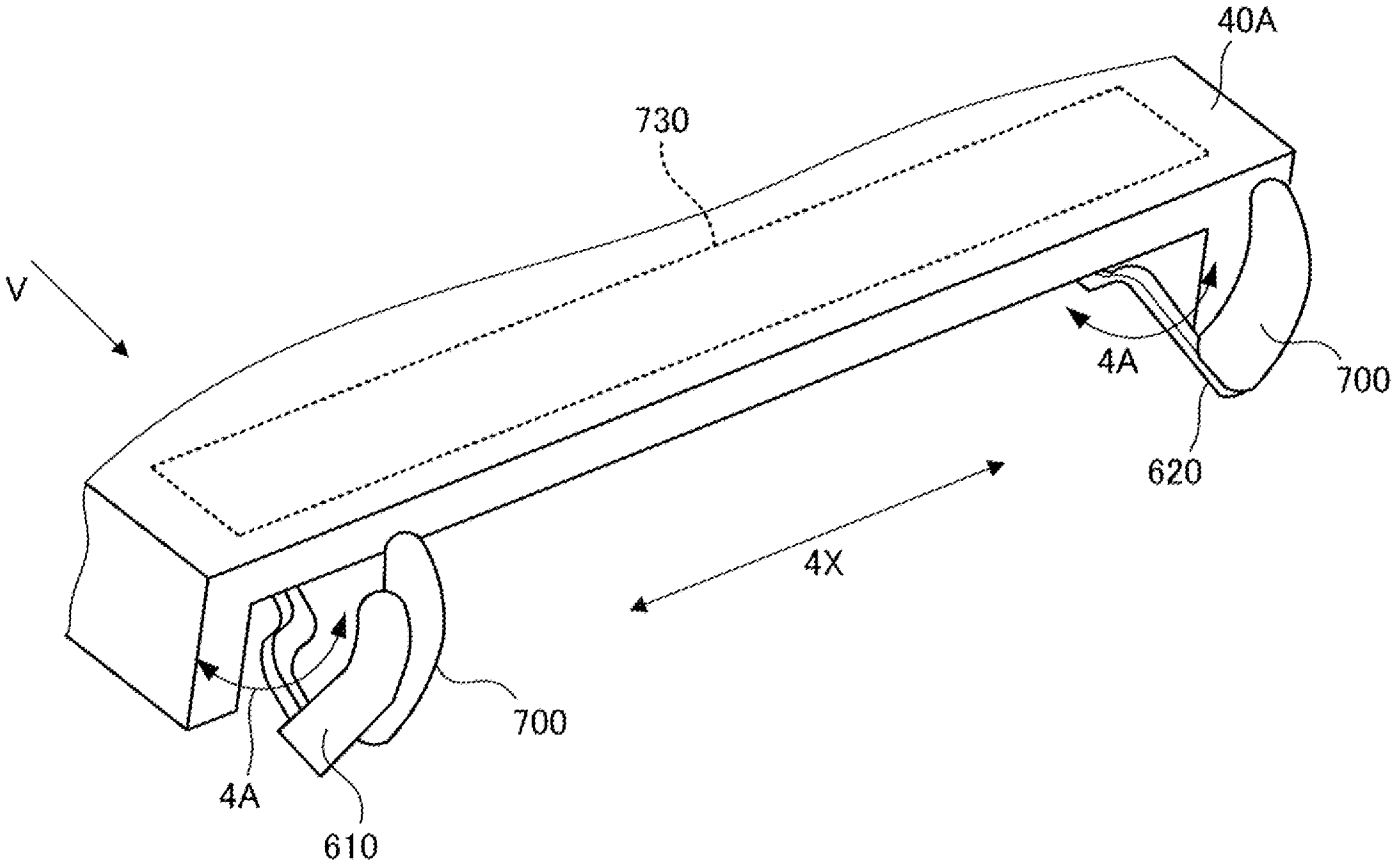
FIG. 4 shows a case where a first advancing member and the like are viewed from a direction indicated by an arrow IV in FIG. 3.

FIG. 4 shows a case where the first advancing member 610 and the like are viewed from a direction indicated by an arrow IV in FIG. 3. In FIG. 4, illustration of the support portion 300 is omitted.

The first advancing member 610 and the second advancing member 620 protrude from a device main body 40A of the first post-processing device 40.

Further, in the exemplary embodiment, a movement mechanism 730 is provided which moves the first advancing member 610 and the second advancing member 620.

In the exemplary embodiment, the movement mechanism 730 allows the first advancing member 610 and the second advancing member 620 to rotate around a rotation center indicated by a reference numeral 3X in FIG. 3 in a direction indicated by arrows 4A in FIG. 4.

In other words, in the exemplary embodiment, the first advancing member 610 and the second advancing member 620 may be moved in an upper-lower direction.

The first loading unit 43 is opened to the outside. When the operator removes the sheets P loaded on the support portion 300, the first advancing member 610 and the second advancing member 620 are positioned in an upward direction and retracted from the sheets P to be taken out.

In the exemplary embodiment, the movement mechanism 730 allows the first advancing member 610 and the second advancing member 620 to move in a direction indicated by an arrow 4X in FIG. 4.

In other words, in the exemplary embodiment, as described above, the first advancing member 610 and the second advancing member 620 may be moved with respect to the edge portions PB of the sheets P (not shown in FIG. 4).

Further, in the exemplary embodiment, the contact members 700 are positioned on sides closer to the sheets P (not shown in FIG. 4) as compared with the first advancing member 610 and the second advancing member 620.

FIG. 5 is a diagram when the first advancing member 610 and a contact member 700 are viewed from a direction indicated by an arrow V in FIG. 4. In the exemplary embodiment, a second advancing member 620 side is configured similarly to a first advancing member 610 side.

The contact member 700 is provided with two protrusions 740 that protrude toward the first advancing member 610 side. In the exemplary embodiment, the contact member 700 is inclined around a location where the protrusions 740 are provided (to be described later).

In other words, in the exemplary embodiment, the two protrusions 740 each have a structure of a shaft. In the exemplary embodiment, the contact member 700 is inclined around each of the shafts.

In the exemplary embodiment, as a protrusion 740, a tip end side protrusion 741 positioned on the tip end 610B side of the first advancing member 610 and a base side protrusion 742 positioned on a base 610A side of the first advancing member 610 are provided.

Here, the two provided protrusions 740 are arranged such that positions in a longitudinal direction of the contact member 700 are different from each other.

Further, the first advancing member 610 is provided with two hole portions 750 into which the protrusions 740 provided on the contact member 700 are inserted.

The contact member 700 of the exemplary embodiment includes a base side end portion 700A positioned on the base 610A side of the first advancing member 610, and an opposite side end portion 700B positioned on a side opposite to the base side end portion 700A (the tip end 610B side of the first advancing member 610).

In the exemplary embodiment, a distance L2 between the tip end side protrusion 741 that is the other protrusion 740 and the opposite side end portion 700B is larger than a distance L1 between the base side protrusion 742 that is one protrusion 740 and the base side end portion 700A.

Here, in the exemplary embodiment, a tip-end-portion-side hole portion 751, which is a hole portion 750 positioned on the tip end 610B side of the first advancing member 610, is configured with a long hole. Here, the long hole is disposed along the longitudinal direction of the contact member 700.

On the other hand, a base side hole portion 752, which is a hole portion 750 positioned on the base 610A side of the first advancing member 610, is configured with a round hole.

Here, in the exemplary embodiment, a cross-sectional area of the tip-end-portion-side hole portion 751 that is one hole portion 750 of the two hole portions 750 (cross-sectional area of a surface orthogonal to an axial direction of the hole portion 750) is larger than a cross-sectional area of the base side hole portion 752 that is the other hole portion 750.

In the exemplary embodiment, when the first advancing member 610 is advanced to the sheets P, a predetermined contact location of the contact member 700 (to be described later) is in contact with the sheets P.

In the exemplary embodiment, between the two hole portions 750, the cross-sectional area of the tip-end-portion-side hole portion 751 positioned on a side close to the contact location is larger than the cross-sectional area of the base side hole portion 752.

In the exemplary embodiment, the coil springs KB, which are an example of an elastic member, are provided between the contact member 700 and the first advancing member 610.

In the present description, although the coil springs KB are described as an example, a member such as a plate spring or rubber may also be used as the elastic member in addition to the coil springs KB.

In the exemplary embodiment, the advancing portion 614 that advances to the sheets P together with the contact member 700 is provided on a side opposite to a side where the sheets P (see FIG. 3) are positioned with respect to the contact member 700 shown in FIG. 5.

In the exemplary embodiment, a plurality of coil springs KB are provided, as an example of an elastic member, between the contact member 700 and the advancing portion 614. Specifically, in the exemplary embodiment, the two coil springs KB including the tip-end-side coil spring KB1 provided on the tip end 610B side of the first advancing member 610 and the base side coil spring KB2 provided on the base 610A side of the first advancing member 610 are provided.

In the exemplary embodiment, the tip-end-side coil spring KB1 is provided around the tip end side protrusion 741, and the base side coil spring KB2 is provided around the base side protrusion 742.

In the exemplary embodiment, regulating screws 220 for regulating movement of the contact member 700 in a direction away from the first advancing member 610 are provided.

In other words, the regulating screws 220 for regulating the movement of the contact member 700 in the direction away from the first advancing member 610 and for preventing detachment of the contact member 700 are provided.

The regulating screws 220 are attached to a tip end portion of the tip end side protrusion 741 and a tip end portion of the base side protrusion 742.

When the contact member 700 attempts to move in the direction away from the first advancing member 610, head portions 221 of the regulating screws 220 push the first advancing member 610. Accordingly, the detachment of the contact member 700 from the first advancing member 610 is prevented.

In the exemplary embodiment, as shown in FIG. 5, in a case where thicknesses in an advancing direction when the contact member 700 is advanced to the sheets P (see FIG. 3) are compared, a thickness W5 of the contact member 700 is smaller than a thickness W6 of the advancing portion 614.

Here, the thickness refers to a thickness of a main body portion formed in a plate shape, and does not refer to a thickness of a location where a thickness is partially increased due to existence of a protruding portion or a thickness of a location where a thickness is partially reduced due to existence of a concave portion.

For example, in the exemplary embodiment, as shown in FIG. 5, although the advancing portion 614 is provided with the protruding portions 614A, the thickness W6 of the advancing portion 614 refers to a thickness of a portion excluding the protruding portion 614A.

Similarly, although the contact member 700 is also provided with the protrusions 740, the thickness W5 of the contact member 700 refers to a thickness of a portion excluding the protrusions 740.

In other words, in the exemplary embodiment, when thicknesses in a direction intersecting a direction in which the edge portions PB of the sheets P (see FIG. 3) extend are compared, the thickness W5 of the contact member 700 and the thickness W6 of the advancing portion 614 are different. In the exemplary embodiment, the thickness W5 of the contact member 700 is smaller than the thickness W6 of the advancing portion 614.

The contact member 700 and the advancing portion 614 are arranged along a direction in which the edge portions PB of the sheets P loaded on the support portion 300 (FIG. 3) extend. When thicknesses in a direction intersecting the extension direction are compared, the thickness W5 of the contact member 700 is smaller than the thickness W6 of the advancing portion 614.

Here, the thickness refers to a thickness of a main body portion formed in a plate shape, and does not refer to a thickness of a location where a thickness is partially increased due to existence of a protruding portion, or a thickness of a location where a thickness is partially reduced due to existence of a concave portion.

For example, in the exemplary embodiment, as shown in FIG. 5, although the advancing portion 614 is provided with the protruding portions 614A, the thickness W6 of the advancing portion 614 refers to a thickness of a portion excluding the protruding portions 614A.

Similarly, although the contact member 700 is also provided with the protrusions 740, the thickness W5 of the contact member 700 refers to a thickness of a portion excluding the protrusions 740.

Figure 12A:
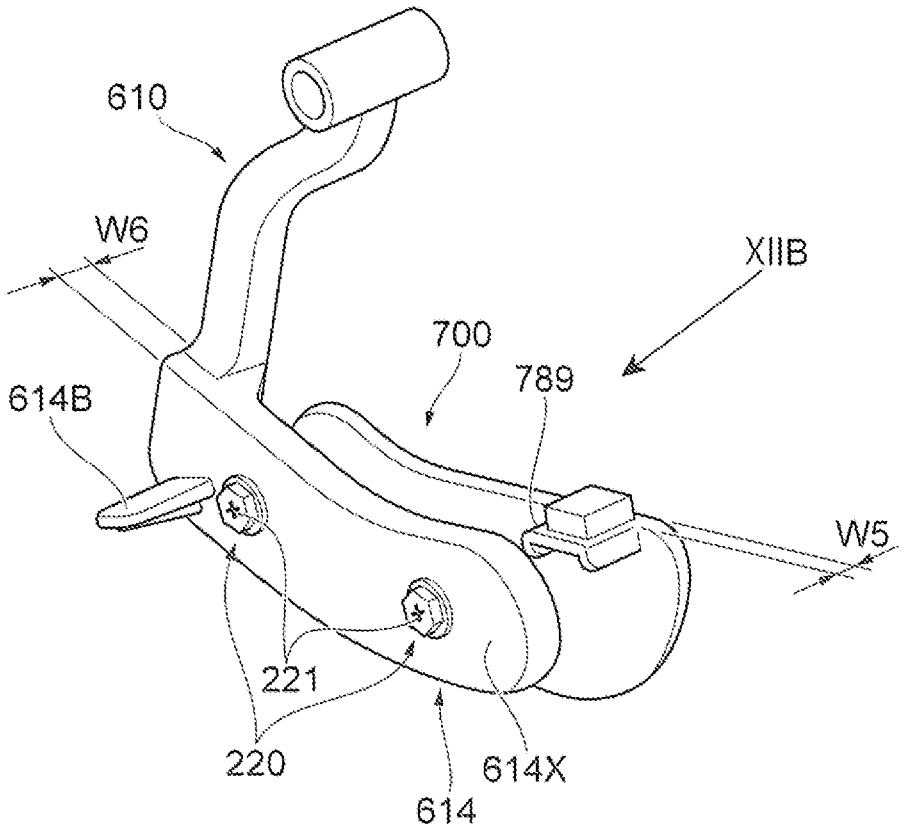
Figure 12B:
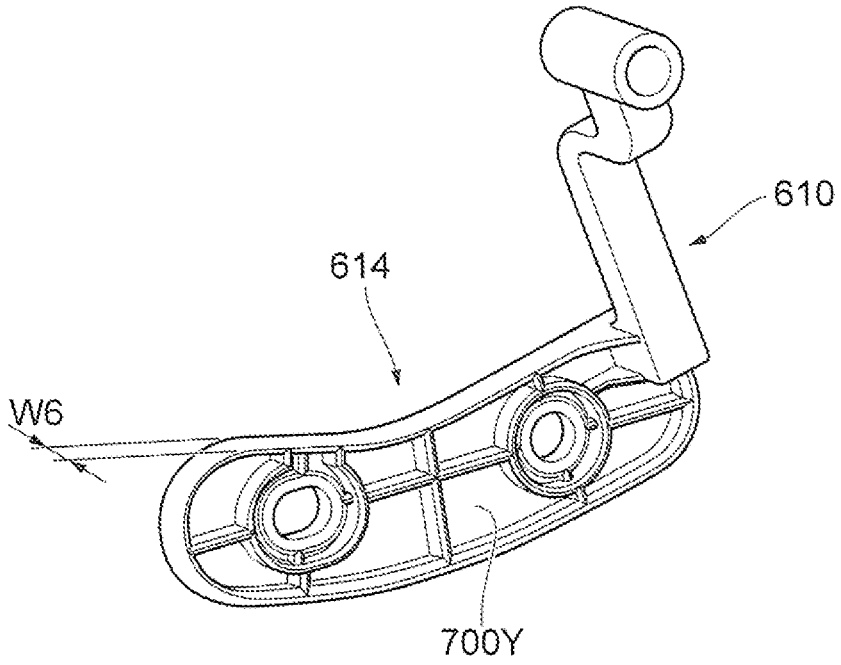

FIGS. 12A and 12B are diagrams showing another configuration example of the contact member 700 and the like. As shown in FIG. 12A, in this configuration example as well, although the advancing portion 614 is provided with a protruding portion 614B, a thickness W6 of the advancing portion 614 refers to a thickness of a portion excluding the protruding portion 614B.

In this configuration example, the protruding portions 614A shown in FIG. 5 are not provided, and the head portions 221 of the regulating screws 220 push a side surface 614X of the plate-shaped advancing portion 614.

Further, in this configuration example shown in FIG. 12A, although the contact member 700 is provided with a protruding portion 789 not shown in FIG. 5, a thickness W5 of the contact member 700 refers to a thickness of a portion excluding the protruding portion 789.

FIG. 12B is a diagram when the advancing portion 614 is viewed from a direction indicated by an arrow XIIB in FIG. 12A. In the advancing portion 614, a plurality of concave portions 700Y are provided on a surface facing a contact member 700 (see FIG. 12A) side.

The thickness W6 of the advancing portion 614 refers to a thickness of a portion where the concave portions 700Y are not provided. In other words, the thickness W6 of the advancing portion 614 refers to a thickness of the advancing portion 614 in a case where the concave portions 700Y are not provided.

Figure 6:
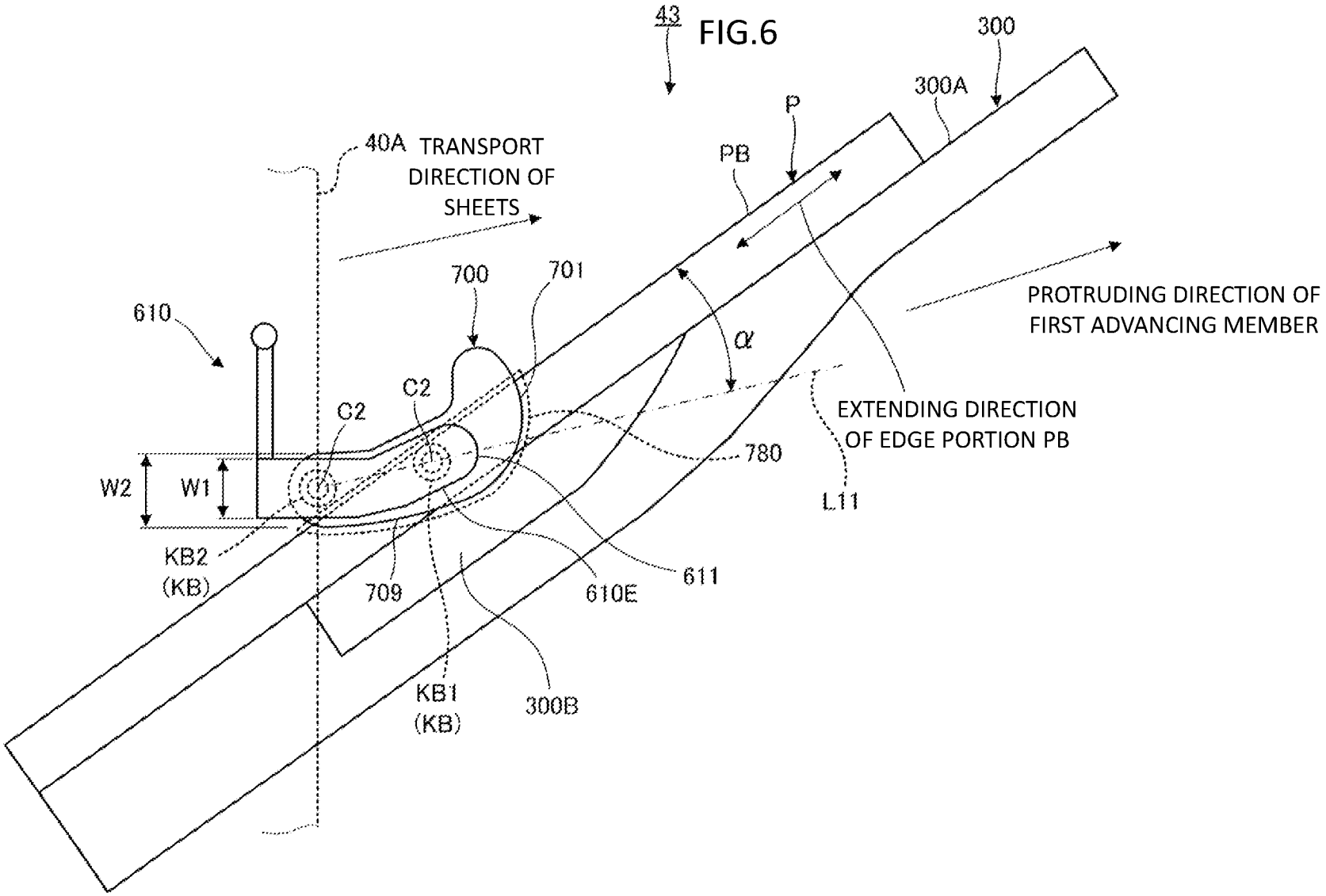
FIG. 6 is a diagram when a support portion, the first advancing member, and the contact member are viewed from a direction indicated by an arrow VI in FIG. 3.

FIG. 6 is a diagram when the support portion 300, the first advancing member 610, and the contact member 700 are viewed from a direction indicated by an arrow VI in FIG. 3.

In the exemplary embodiment, each time the sheets P are transported to the support portion 300, the first advancing member 610 is advanced to the sheets P, and the contact member 700 is pushed against an edge portion PB of the sheets P.

At this time, the second advancing member 620 (not shown in FIG. 6) is also advanced to the sheets P, and a contact member 700 provided on a second advancing member 620 side is pushed against an edge portion PB of the sheets P.

When the contact member 700 is pushed against the edge portion PB of the sheets P, a predetermined contact location 780 of the contact member 700 is in contact with the sheets P in the exemplary embodiment.

Here, in the exemplary embodiment, the tip-end-portion-side hole portion 751 (see FIG. 5) is positioned on a side close to the contact location 780. In the exemplary embodiment, the cross-sectional area of the tip-end-portion-side hole portion 751 is larger than the cross-sectional area of the base side hole portion 752.

Accordingly, in the exemplary embodiment, the contact location 780 (see FIG. 6) of the contact member 700 is easier to move as compared with a case where a cross-sectional area of the tip-end-portion-side hole portion 751 is smaller than a cross-sectional area of the base side hole portion 752.

In other words, a side of the contact member 700 where the contact location 780 is positioned is easily retracted to the first advancing member 610 side. Although a region of the contact location 780 is a part of the contact member in the exemplary embodiment, more regions of the contact member may be in contact with the sheets P. In this case, the contact location 780 becomes wider than that in FIG. 6. In a case where such a contact location 780 is applied to both holes when viewed from a direction of FIG. 6, a hole portion positioned closer to a center of the contact location is closer to the contact location.

FIG. 6 shows a state where the first advancing member 610 and the contact member 700 are viewed from an upstream side in an advancing direction of the first advancing member 610.

Accordingly, when the first advancing member 610 and the contact member 700 are viewed from the upstream side in the advancing direction of the first advancing member 610, the contact member 700 is larger than the first advancing member 610 in the exemplary embodiment.

More specifically, in the exemplary embodiment, in a protruding direction of the first advancing member 610, an end portion 701 of the contact member 700 is positioned downstream of a tip end portion 611 of the first advancing member 610 in the protruding direction of the first advancing member 610.

In the exemplary embodiment, a width of the contact member 700 is larger than a width of the first advancing member 610.

More specifically, in the exemplary embodiment, when widths in a direction orthogonal to the protruding direction of the first advancing member 610 are compared, a width W2 of the contact member 700 is larger than a width W1 of the first advancing member 610.

Further, in the exemplary embodiment, a lower edge portion 709 of the contact member 700 is positioned below a lower edge portion 610E of the first advancing member 610.

Furthermore, in the exemplary embodiment, a thickness of the first advancing member 610 is larger than a thickness of the contact member 700.

In the exemplary embodiment, when the first advancing member 610 is advanced to the sheets P, as shown in FIG. 6, the plurality of coil springs KB are arranged such that positions in a direction in which an edge portion PB extends are different from each other.

More specifically, in this case, the base side coil spring KB2 is positioned on an upstream side in the transport direction of the sheets P, and the tip-end-side coil spring KB1 is positioned on a downstream side in the transport direction of the sheets P.

In the exemplary embodiment, in order to avoid interference among the first advancing member 610, the contact member 700, and the support portion 300, a concave portion 300B is formed in an upper surface 300A of the support portion 300.

Further, in the exemplary embodiment, a position of the sheets P with respect to the first advancing member 610 is shifted. More specifically, in the exemplary embodiment, the sheets P may be moved in an upper-lower direction, which is relative movement of the sheets P with respect to the first advancing member 610.

The relative movement of the sheets P with respect to the first advancing member 610 is performed by, for example, moving the support portion 300 in the upper-lower direction.

More specifically, for example, movement of the sheets P in the upper-lower direction, which is movement of the sheets P with respect to the first advancing member 610, is performed by moving the support portion 300 in the upper-lower direction so as to move a loading position of the sheets P upward or downward.

In the exemplary embodiment, an elastic member is provided between the contact member 700 and the first advancing member 610. After providing the elastic member between the contact member 700 and the first advancing member 610, a spring may be further disposed on the rotation shaft 612 (see FIG. 5) so as to double absorb an impact.

On the other hand, as a comparative example, even when a spring is provided only on the rotation shaft 612 and the contact member 700 and the entire first advancing member 610 are integrally formed as a contact movable portion (not shown), a contact portion may be advanced to the sheets P. However, in a case of the integrated contact movable portion, since an impact received on a side of the sheets is not absorbed by the side of the sheets but by the rotation shaft 612 that is a rotation fulcrum, rigidity of the contact movable portion is required. In this case, since a load on the rotation shaft 612 becomes large, the comparative example is not suitable.

Figure 7:
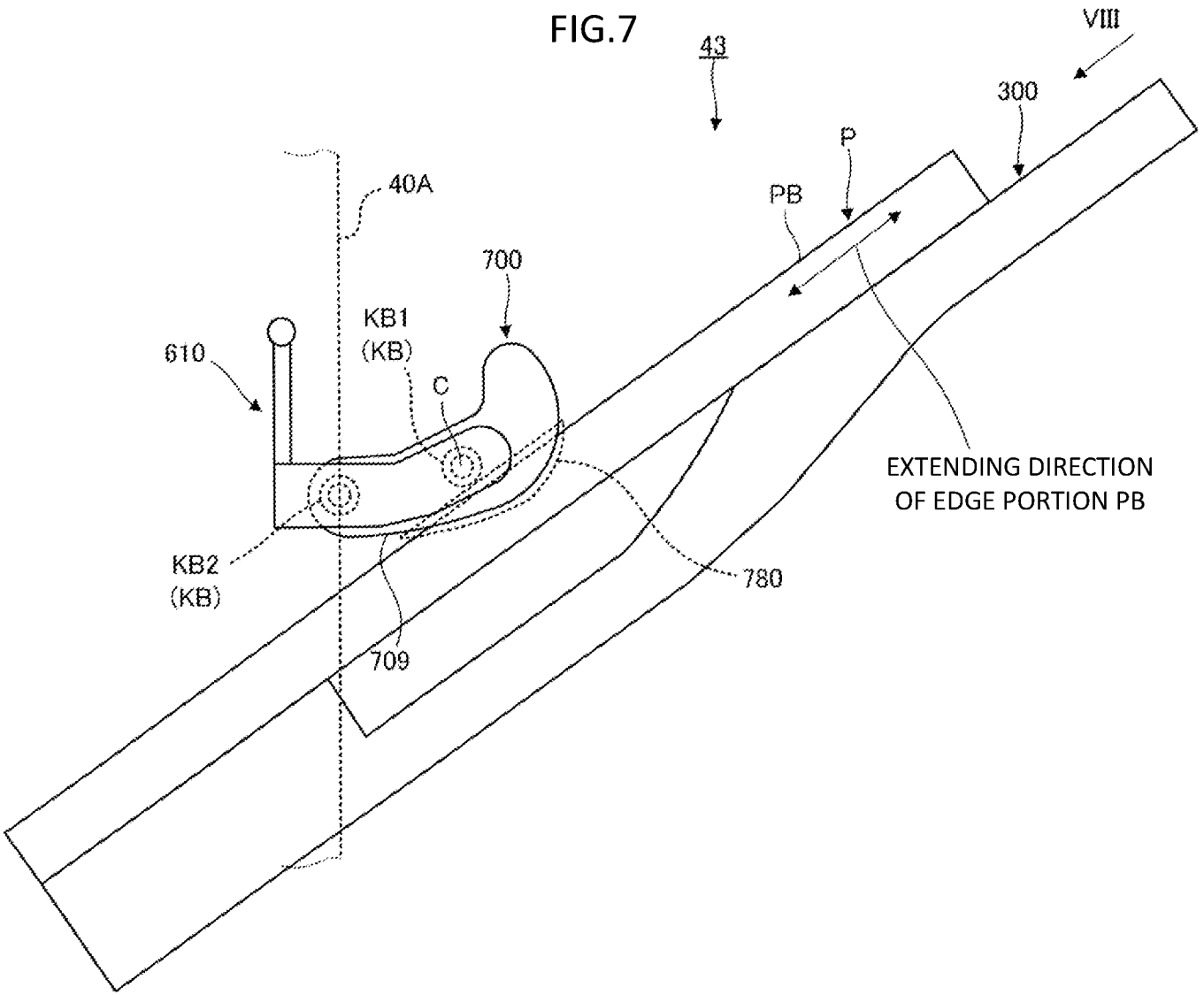
FIG. 7 is a diagram showing another arrangement example of the support portion, sheets, the first advancing member, and the contact member.

FIG. 7 is a diagram showing another arrangement example of the support portion 300, sheets P, the first advancing member 610, and the contact member 700.

In this arrangement example, the support portion 300 is lowered from a state shown in FIG. 6, and a portion of the contact member 700 closer to the lower edge portion 709 is in contact with the sheets P.

More specifically, in this arrangement example, a portion of the contact member 700 positioned below the tip-end-side coil spring KB1 is in contact with the sheets P.

In other words, in this arrangement example, a portion of the contact member 700 positioned below a central axis C of the tip-end-side coil spring KB1 is in contact with the sheets P.

Figure 8:
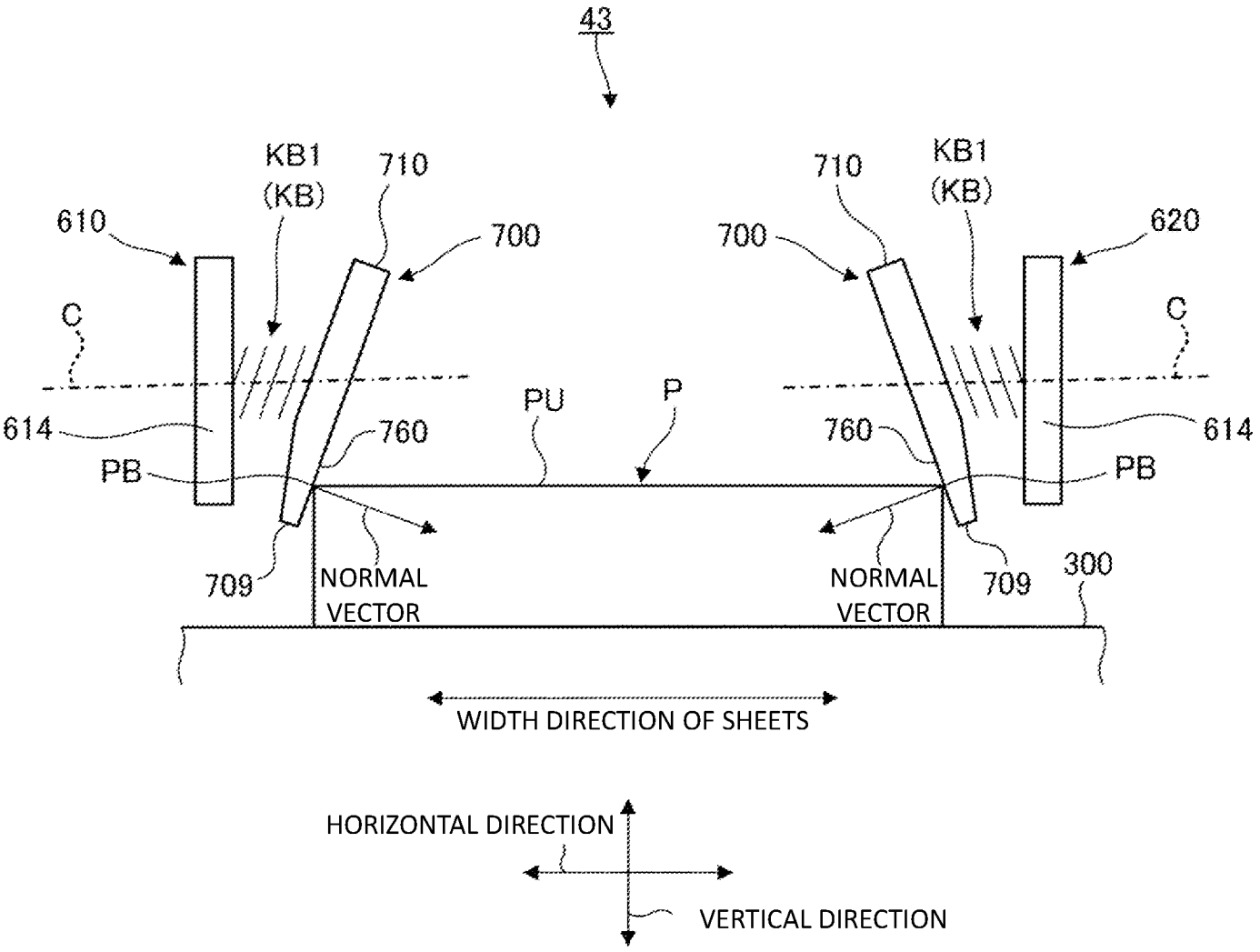
FIG. 8 is a diagram when the support portion, the sheets, the first advancing member, a second advancing member, and the contact member are viewed from a direction indicated by an arrow VIII in FIG. 7.

FIG. 8 is a diagram when the support portion 300, the sheets P, the first advancing member 610, the second advancing member 620, and the contact member 700 are viewed from a direction indicated by an arrow VIII in FIG. 7.

In this arrangement example shown in FIGS. 7 and 8, a portion of a contact member 700 positioned below a tip-end-side coil spring KB1 is in contact with the sheets P.

In this case, as shown in FIG. 8, the contact members 700 are inclined and the contact members 700 cover the edge portions PB of the sheets P.

When the portion of the contact member 700 positioned below the tip-end-side coil spring KB1 is in contact with the sheets P, a surface of the contact member 700 that pushes the sheets P faces obliquely downward. In this case, the contact member 700 covers an edge portion PB of the sheets P.

In this case, a load acts on the sheets P also from above the edge portion PB. In other words, in this case, a load acts not only from the side of the sheets P but also from above the sheets P, and a load that pushes the sheets P from above acts on the sheets P.

A contact member 700 of the exemplary embodiment has a contact surface 760 in contact with an edge portion PB of the sheets P.

In the exemplary embodiment, as shown in FIG. 8, when a contact surface 760 is in contact with an edge portion PB and pushes the edge portion PB, the contact surface 760 faces obliquely downward. In other words, the contact surface 760 is inclined with respect to the vertical direction and faces the sheet P side and downward. In other words, the contact surface 760 is disposed such that a normal vector with respect to the contact surface 760 faces obliquely downward.

Further, in the exemplary embodiment, when the contact surface 760 is in contact with the edge portion PB of the sheets P and the contact surface 760 pushes the edge portion PB, an upper edge portion 710 of the contact member 700 is positioned at a location facing an upper surface PU of an uppermost sheet P.

In the exemplary embodiment, the portion of the contact member 700 positioned below the central axis C of the tip-end-side coil spring KB1 is in contact with the edge portion PB of the sheets P.

In the exemplary embodiment, a coil spring KB that pushes the contact member 700 toward the sheet P side is provided on a side opposite to a side where the sheets P are positioned with respect to the contact member 700.

In the exemplary embodiment, a portion of the contact member 700 positioned below a central axis C of the coil spring KB is in contact with the edge portion PB of the sheets P.

In the exemplary embodiment, as described above, an advancing portion 614 that advances to the sheets P together with a contact member 700 is provided on the side opposite to the side where the sheets P are positioned with respect to the contact member 700. The contact member 700 is supported by the advancing portion 614.

In the exemplary embodiment, when a contact surface 760 is in contact with an edge portion PB and pushes the edge portion PB, the contact member 700 is disposed in a state of being inclined with respect to the vertical direction.

Specifically, in the exemplary embodiment, the contact member 700 is formed in a plate shape. When the contact surface 760 pushes the edge portion PB, the contact member 700 is disposed in a state of being inclined with respect to the vertical direction.

On the contrary, when the contact surface 760 pushes the edge portion PB, the advancing portion 614 is disposed in a state of being along the vertical direction as shown in FIG. 8.

Specifically, the advancing portion 614 is formed in a plate shape. When the contact surface 760 pushes the edge portion PB, the plate-shaped advancing portion 614 is disposed in a state of being along the vertical direction as shown in FIG. 8.

The contact member 700 of the exemplary embodiment changes a posture thereof when the contact member 700 is advanced toward the sheets P and is in contact with the edge portion PB of the sheets P. Then, with the change of the posture, the contact surface 760 faces obliquely downward.

On the contrary, the advancing portion 614 does not change a posture thereof even after the contact surface 760 of the contact member 700 is in contact with the edge portion PB.

More specifically, the advancing portion 614 is along the vertical direction. Even after the contact surface 760 of the contact member 700 is in contact with the edge portion PB, the advancing portion 614 does not change the posture thereof, and the advancing portion 614 is maintained in a state of being along the vertical direction.

When the contact member 700 is retracted from the sheets P, as shown in FIG. 12 (diagram showing a state of the contact member 700 retracted from the sheets P, and the like), the contact member 700 and the contact surface 760 are arranged along the vertical direction.

In the exemplary embodiment, when the contact member 700 is in contact with the sheets P, a load acts on the contact member 700 from the sheets P. In the exemplary embodiment, the load that acts on the contact member 700 causes the contact member 700 to be inclined, and accordingly, the contact surface 760 faces obliquely downward.

More specifically, in the exemplary embodiment, as shown in FIG. 8, the load from the sheets P acts on a location of the contact member 700 positioned on a side close to the lower edge portion 709.

More specifically, the contact member 700 of the exemplary embodiment includes the upper edge portion 710 and the lower edge portion 709, and the load from the sheets P acts on the location of the contact member 700 positioned on the side close to the lower edge portion 709. In other words, in the exemplary embodiment, the side of the contact member 700 close to the lower edge portion 709 is in contact with the edge portion PB of the sheets P.

Next, a processing example when sheets P are loaded alternately will be described. In other words, a processing example when the sheets P are offset and loaded will be described.

Figure 9:
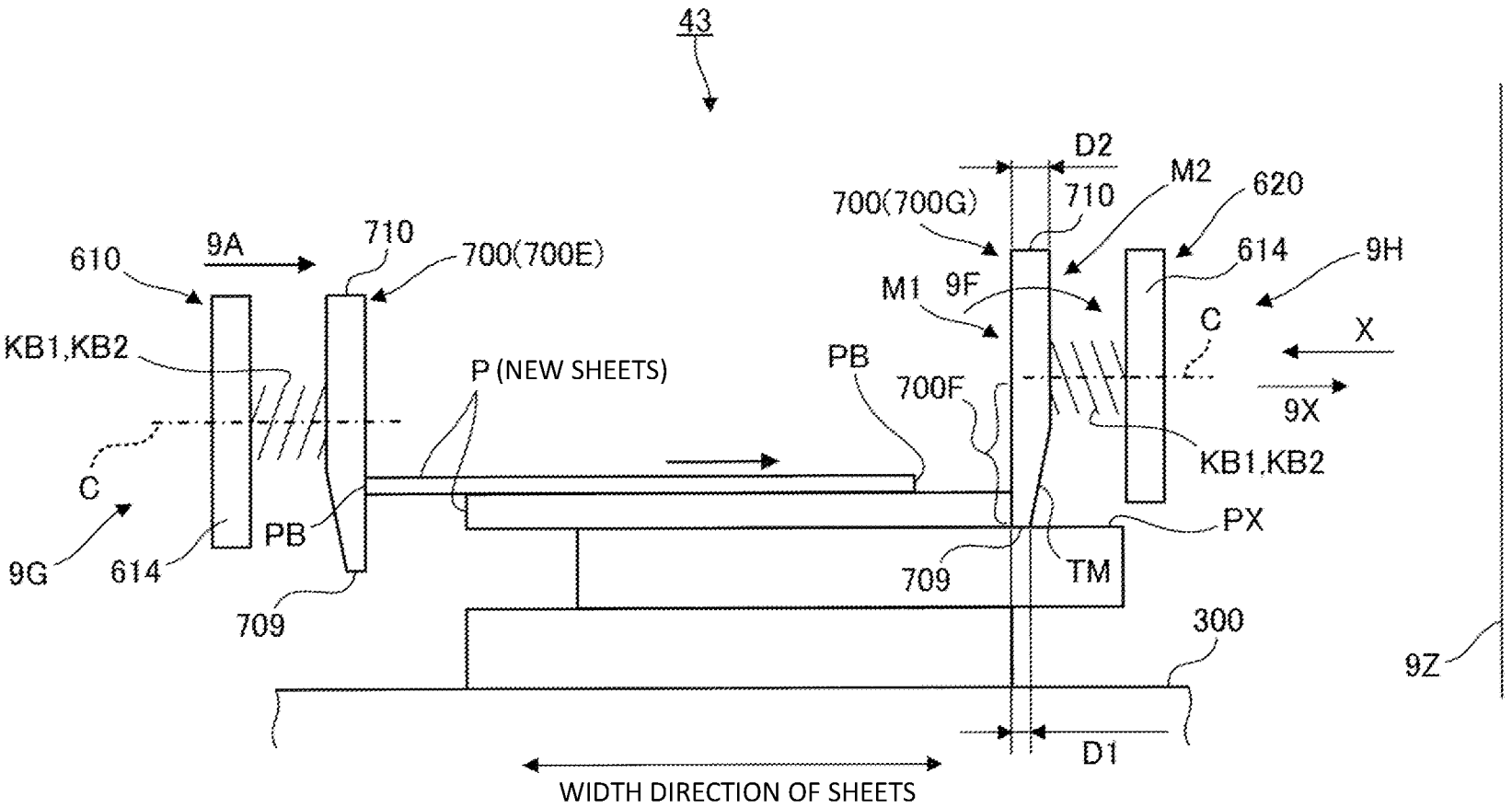
FIG. 9 is a diagram illustrating a processing example when sheets are loaded alternately.

In the exemplary embodiment, as shown in FIG. 9 (diagram illustrating a processing example when the sheets P are loaded alternately), each time a predetermined number of sheets P are loaded, a loading position of the sheets P in a width direction is shifted so as to load the sheets P, and the sheets P may be loaded alternately.

More specifically, sheets P loaded at a first position and sheets P loaded at a second position whose positions of the sheets P in the width direction are different from those of the first position may be loaded alternately.

In other words, in the exemplary embodiment, new sheets P may be loaded on already loaded sheets PX that are sheets P already loaded on the support portion 300, and the new sheets P may be loaded while positions of the already loaded sheets PX are shifted.

Accordingly, when the sheets P are loaded alternately, as shown in FIG. 9, for example, while the first advancing member 610 is advanced to the sheets P, the second advancing member 620, which is the other advancing member, receives the sheets P pushed and moved by the first advancing member 610.

Here, on the first advancing member 610 side, which is a pushing side of the sheets P, the contact member 700 (hereinafter, referred to as "pushing side contact member 700E") is pushed against an edge portion PB of the sheets P.

Further, the second advancing member 620 side, which is a receiving side of the sheets P, has a position thereof fixed. The sheets P are moved toward the fixed second advancing member 620 side, and the movement of the sheets P is stopped by the second advancing member 620 side.

Further, on the second advancing member 620 side, the contact member 700 provided on the second advancing member 620 side (hereinafter, referred to as "receiving side contact member 700G") is disposed in contact with an upper surface of the already loaded sheets PX.

Here, in the exemplary embodiment, the second advancing member 620 side functions as a receiving portion. In the exemplary embodiment, the sheets P that move as the first advancing member 610 is advanced are received at the second advancing member 620 side.

More specifically, the receiving side contact member 700G attached to the second advancing member 620 receives the sheets P.

More specifically, in the exemplary embodiment, an edge portion PB of the moved sheets P is in contact with the receiving side contact member 700G, the movement of the sheets P is regulated, and the sheets P are stopped at a predetermined position.

At this time, in the exemplary embodiment, the tip-end-side coil spring KB1 and the base side coil spring KB2, arranged between the receiving side contact member 700G and the second advancing member 620, support the receiving side contact member 700G.

In the exemplary embodiment, the edge portion PB of the moved sheets P is pushed against the receiving side contact member 700G provided on the second advancing member 620 side.

More specifically, in the exemplary embodiment, the pushing side contact member 700E, which is an example of a pushing member, pushes the sheets P toward the receiving side contact member 700G. Accordingly, the edge portion PB of the sheets P is pushed against the receiving side contact member 700G.

In the exemplary embodiment, the pushing side contact member 700E is provided on a side opposite to an installation side of the receiving side contact member 700G with respect to the sheets P newly loaded on the support portion 300.

In the exemplary embodiment, the pushing side contact member 700E pushes the sheets P newly loaded on the support portion 300 toward the receiving side contact member 700G.

When the pushing side contact member 700E pushes the sheets P, a load from the sheets P acts on the pushing side contact member 700E.

At this time, in the exemplary embodiment, the tip-end-side coil spring KB1 and the base side coil spring KB2 that are provided behind the pushing side contact member 700E receive the load that acts on the pushing side contact member 700E.

The receiving side contact member 700G is disposed on a side of the sheets P newly loaded on the support portion 300. In the exemplary embodiment, the edge portion PB of the sheets P is pushed against the receiving side contact member 700G.

A tip-end-side coil spring KB1 and a base side coil spring KB2 are arranged between the receiving side contact member 700G and the second advancing member 620.

The tip-end-side coil spring KB1 and the base side coil spring KB2, which are an example of an elastic member, receive a load from the receiving side contact member 700G against which the edge portion PB of the sheets P is pushed.

In the exemplary embodiment, as indicated by a reference numeral 9G, an advancing portion 614 provided on the first advancing member 610 supports the pushing side contact member 700E. The advancing portion 614 is an example of a member support portion, and supports the pushing side contact member 700E via the tip-end-side coil spring KB1 and the base side coil spring KB2.

Here, in the exemplary embodiment, the advancing portion 614 provided on the first advancing member 610 is disposed in a state without contacting the sheets P loaded on the support portion 300.

Similarly, on the second advancing member 620 side, as indicated by a reference numeral 9H, an advancing portion 614 provided on the second advancing member 620 side supports the receiving side contact member 700G.

Here, the advancing portion 614 provided on the second advancing member 620 side is also an example of the member support portion. The advancing portion 614 supports the receiving side contact member 700G via the tip-end-side coil spring KB1 and the base side coil spring KB2.

Further, in the same manner as described above, the advancing portion 614 provided on the second advancing member 620 side is also disposed in a state without contacting the sheets P loaded on the support portion 300.

The receiving side contact member 700G is provided so as to be movable to a side opposite to a side where the sheets P are positioned. Specifically, the receiving side contact member 700G is provided so as to be movable in a right direction in the figure.

Accordingly, for example, even when the sheets P are excessively pushed by the pushing side contact member 700E, the receiving side contact member 700G is retracted and deformation and the like of the sheets P are prevented.

More specifically, when the sheets P are excessively pushed by the pushing side contact member 700E, the receiving side contact member 700G is likely to rotate around the lower edge portion 709 in a direction indicated by an arrow 9F.

In other words, the receiving side contact member 700G is likely to fall in the direction indicated by the arrow 9F. Accordingly, a load that acts on the sheets P is reduced, and the deformation and the like of the sheets P are prevented.

In other words, in the exemplary embodiment, a lower edge portion 709 of the receiving side contact member 700G is in contact with the already loaded sheets PX, receives a drag force from the sheets P, and is unlikely to move. On the other hand, a portion of the receiving side contact member 700G positioned above the lower edge portion 709 is pushed by the new sheets P and is likely to fall in the direction indicated by the arrow 9F.

In this case, as described above, the load that acts on the sheets P is reduced and the deformation and the like of the sheets P are prevented.

Further, in the exemplary embodiment, as described above, the lower edge portion 709 of the receiving side contact member 700G is unlikely to move. In this case, the already loaded sheets PX positioned below the receiving side contact member 700G are less likely to move, and a position shift of the already loaded sheets PX is unlikely to occur.

In the exemplary embodiment, a tapered surface TM is attached to the receiving side contact member 700G. Accordingly, the receiving side contact member 700G is more likely to fall.

In other words, in the exemplary embodiment, the tapered surface TM is attached to a surface of the receiving side contact member 700G positioned on a side where the receiving side contact member 700G falls, so that the receiving side contact member 700G is more likely to fall.

Further, in the exemplary embodiment, a thickness D1 of the lower edge portion 709 of the receiving side contact member 700G is smaller than a thickness D2 of the upper edge portion 710, and the receiving side contact member 700G is more likely to fall as compared with a case where the thickness D1 of the lower edge portion 709 is larger than the thickness D2 of the upper edge portion 710.

Here, a variation often exists in a size of a sheet P, and a sheet P having a size larger than a specified value may exist.

In this case, the sheet P having a size larger than the specified value is excessively pushed by the first advancing member 610 and the second advancing member 620, and in this case, the sheet P may be deformed or the sheet P may be disturbed.

On the contrary, in the exemplary embodiment, when there is the sheet P having a size larger than a specified value, the receiving side contact member 700G is retracted.

Accordingly, an excessive load is prevented from acting on the sheets P, and deformation of the sheets P and disturbance of the sheets P are prevented.

In the exemplary embodiment, after being retracted, the receiving side contact member 700G returns to a position before the retraction. Accordingly, the sheets P are pushed back, and the sheets P are stopped at a predetermined alignment position.

More specifically, when pushing of the sheets P by the pushing side contact member 700E is released, the receiving side contact member 700G pushed by the tip-end-side coil spring KB1 and the base side coil spring KB2 returns to a position before the retraction. Accordingly, the sheets P return to the predetermined alignment position.

Here, in the exemplary embodiment, the advancing portion 614 provided on the second advancing member 620 side is disposed on a side opposite to the sheets P loaded on the support portion 300 with respect to the receiving side contact member 700G.

In the exemplary embodiment, the tip-end-side coil spring KB1 and the base side coil spring KB2, which are an example of an elastic member, are provided between the advancing portion 614 disposed on the side opposite to the sheets P and the receiving side contact member 700G.

In other words, in the exemplary embodiment, the tip-end-side coil spring KB1 and the base side coil spring KB2 are provided between the receiving side contact member 700G and the advancing portion 614 disposed at a position facing the receiving side contact member 700G.

In the exemplary embodiment, as described above, when pushed by the sheet P having a size larger than a specified value and the like, the receiving side contact member 700G is retracted to an advancing portion 614 side.

Thereafter, the receiving side contact member 700G returns to an original position by an urging force from the tip-end-side coil spring KB1 and the base side coil spring KB2 positioned between the receiving side contact member 700G and the advancing portion 614. Accordingly, the sheets P are aligned.

Here, in the exemplary embodiment, when the receiving side contact member 700G is retracted to the advancing portion 614 side, the pushing side contact member 700E is also retracted to the advancing portion 614 provided on the first advancing member 610.

In FIG. 9, although a case where the first advancing member 610 is advanced and the second advancing member 620 receives the sheets P is shown, when a loading position of the sheets P is changed to the other loading position and the sheets P are loaded, the second advancing member 620 is advanced to the sheets P and the first advancing member 610 side receives the sheets P.

In the exemplary embodiment, the loading position of the sheets P is changed by moving the support portion 300 in a width direction of the sheets P.

However, the present invention is not limited thereto. The loading position of the sheets P may be changed by using another method such as moving a discharge port through which the sheets P are discharged toward the first loading unit 43 in the width direction of the sheets P.

Here, in the exemplary embodiment, as shown in FIG. 9, the first advancing member 610 that is a side where the sheets P are pushed is disposed below the second advancing member 620 that is a side where the sheets P are received.

Further, the first advancing member 610, which is the side where the sheets P are pushed, is disposed in the state shown in FIGS. 6 and 7.

In this case, on the first advancing member 610 side, the contact location 780 (see FIGS. 6 and 7) is in contact with the sheets P as described above.

On the other hand, the second advancing member 620 side, which is the side where the sheets P are received, is disposed above the already loaded sheets PX as shown in FIG. 9.

More specifically, in the exemplary embodiment, the receiving side contact member 700G provided on the second advancing member 620 side is placed on the already loaded sheets PX. More specifically, the receiving side contact member 700G provided on the second advancing member 620 side is disposed in contact with the already loaded sheets PX.

On the other hand, in the exemplary embodiment, the advancing portion 614 provided on the second advancing member 620 side is disposed above the already loaded sheets PX, and is disposed in a state without contacting the already loaded sheets PX.

Further, in the exemplary embodiment, when the new sheets P are loaded on the already loaded sheets PX, as indicated by an arrow 9A, the first advancing member 610 is advanced from a side opposite to the second advancing member 620 toward the new sheets P with respect to the new sheets P. Accordingly, the edge portion PB of the sheets P is pushed against the receiving side contact member 700G.

In the exemplary embodiment, as shown in FIG. 9, a central axis C of the tip-end-side coil spring KB1 and the base side coil spring KB2 that are provided on a pushing side contact member 700E side is positioned below a central axis C of the tip-end-side coil spring KB1 and the base side coil spring KB2 that are provided on a receiving side contact member 700G side.

More specifically, the central axis C of the tip-end-side coil spring KB1 and the base side coil spring KB2 that receive a load from the pushing side contact member 700E is positioned below the central axis C of the tip-end-side coil spring KB1 and the base side coil spring KB2 that receive a load from the receiving side contact member 700G.

In the exemplary embodiment, a lower edge portion 709 of the pushing side contact member 700E is positioned below the lower edge portion 709 of the receiving side contact member 700G.

Each of the pushing side contact member 700E and the receiving side contact member 700G is provided to move in an upper-lower direction. In the exemplary embodiment, the pushing side contact member 700E that is a pushing side is disposed below the receiving side contact member 700G that is a receiving side.

In the exemplary embodiment, as shown in FIG. 9, the edge portion PB of the sheets P newly loaded on the support portion 300 is pushed against the lower edge portion 709 of the receiving side contact member 700G and a side of the upper edge portion 710 close to the lower edge portion 709.

Further, in the exemplary embodiment, the edge portion PB of the sheets P is pushed against a portion of the receiving side contact member 700G positioned below the central axis C of the tip-end-side coil spring KB1 and the base side coil spring KB2 (the tip-end-side coil spring KB1 and the base side coil spring KB2 positioned on a right side of the figure).

In the exemplary embodiment, when the edge portion PB of the sheets P is pushed against the receiving side contact member 700G, the lower edge portion 709 of the receiving side contact member 700G is in contact with the already loaded sheets PX.

Further, in the exemplary embodiment, in a state where the lower edge portion 709 of the receiving side contact member 700G is in contact with the already loaded sheets PX, the edge portion PB of the sheets P is pushed against the portion of the receiving side contact member 700G positioned below the central axis C of the tip-end-side coil spring KB1 and the base side coil spring KB2.

In the exemplary embodiment, as described above, when the receiving side contact member 700G provided on the second advancing member 620 side is in contact with the already loaded sheets PX, the lower edge portion 709 of the receiving side contact member 700G is in contact with the already loaded sheets PX.

Further, in the exemplary embodiment, as described above, the thickness D1 of the lower edge portion 709 of the receiving side contact member 700G is smaller than the thickness D2 of the upper edge portion 710.

More specifically, the receiving side contact member 700G of the exemplary embodiment is formed in a plate shape and disposed along a transport direction of the sheets P. In the plate-shaped receiving side contact member 700G, the thickness D1 of the lower edge portion 709 is smaller than the thickness D2 of the upper edge portion 710.

In other words, in the exemplary embodiment, when thicknesses in a movement direction of the first advancing member 610 and the second advancing member 620 are compared, the thickness of the lower edge portion 709 is smaller than the thickness of the upper edge portion 710.

The same applies to the pushing side contact member 700E. A thickness of the lower edge portion 709 of the pushing side contact member 700E is smaller than a thickness of the upper edge portion 710.

In the exemplary embodiment, as described above, the tapered surface TM is attached to the receiving side contact member 700G. Accordingly, as described above, the receiving side contact member 700G is likely to fall.

In the exemplary embodiment, as shown in FIG. 9, a lower side portion 700F of the receiving side contact member 700G, which is positioned on a lower side, has a thickness that decreases toward the lower edge portion 709.

In other words, in the exemplary embodiment, a surface of the receiving side contact member 700G, which is on a side where the second advancing member 620 is positioned, is tapered. In the lower side portion 700F of the receiving side contact member 700G, a thickness of the receiving side contact member 700G gradually decreases toward the lower edge portion 709.

More specifically, the exemplary embodiment, an inclination that is gradually away from the second advancing member 620 as the inclination goes downward is given to a lower portion of a surface of the receiving side contact member 700G that faces the second advancing member 620 side. Accordingly, at the lower side portion 700F, the thickness of the receiving side contact member 700G becomes smaller toward the lower edge portion 709.

More specifically, the lower portion of the surface of the receiving side contact member 700G that faces the second advancing member 620 side is provided with the tapered surface TM. At the lower side portion 700F, the thickness of the receiving side contact member 700G becomes smaller toward the lower edge portion 709.

More specifically, the receiving side contact member 700G includes a pushed surface M1 that is a surface against which the edge portion PB of the sheets P is pushed and an opposite surface M2 that is a surface positioned on a side opposite to the pushed surface M1.

In the exemplary embodiment, the opposite surface M2 is provided with the tapered surface TM that is an example of an inclined surface. The tapered surface TM is inclined with respect to a vertical direction and gradually increases in a distance from the pushed surface M1 as the tapered surface TM goes upward.

Further, the tapered surface TM of the exemplary embodiment extends upward from the lower edge portion 709 of the receiving side contact member 700G serving as a starting point.

In the exemplary embodiment, the tapered surface TM is provided at a location of the receiving side contact member 700G that is not in contact with the base side coil spring KB2 and the tip-end-side coil spring KB1.

In other words, in the exemplary embodiment, when the tapered surface TM, the base side coil spring KB2, and the tip-end-side coil spring KB1 are projected in a direction indicated by an arrow 9X in the figure, there is no overlap between the tapered surface TM and the base side coil spring KB2, and between the tapered surface TM and the tip-end-side coil spring KB1.

In other words, in the exemplary embodiment, when the tapered surface TM, the base side coil spring KB2, and the tip-end-side coil spring KB1 are projected toward a surface 9Z that faces a thickness direction of the receiving side contact member 700G and is parallel to the receiving side contact member 700G, there is no overlap between the tapered surface TM and the base side coil spring KB2, and between the tapered surface TM and the tip-end-side coil spring KB1.

Accordingly, in the exemplary embodiment, deformation of the receiving side contact member 700G may be prevented while giving the receiving side contact member 700G a tapered shape.

Here, when there is the tapered surface TM at a location of the receiving side contact member 700G where the base side coil spring KB2 and the tip-end-side coil spring KB1 are in contact with each other, the receiving side contact member 700G is easily deformed due to the small thickness of the receiving side contact member 700G in a portion where the tapered surface TM is formed.

On the contrary, as described above, when there is the tapered surface TM at a location of the receiving side contact member 700G that is not in contact with the base side coil spring KB2 and the tip-end-side coil spring KB1, deformation of the receiving side contact member 700G is prevented.

Figure 10:
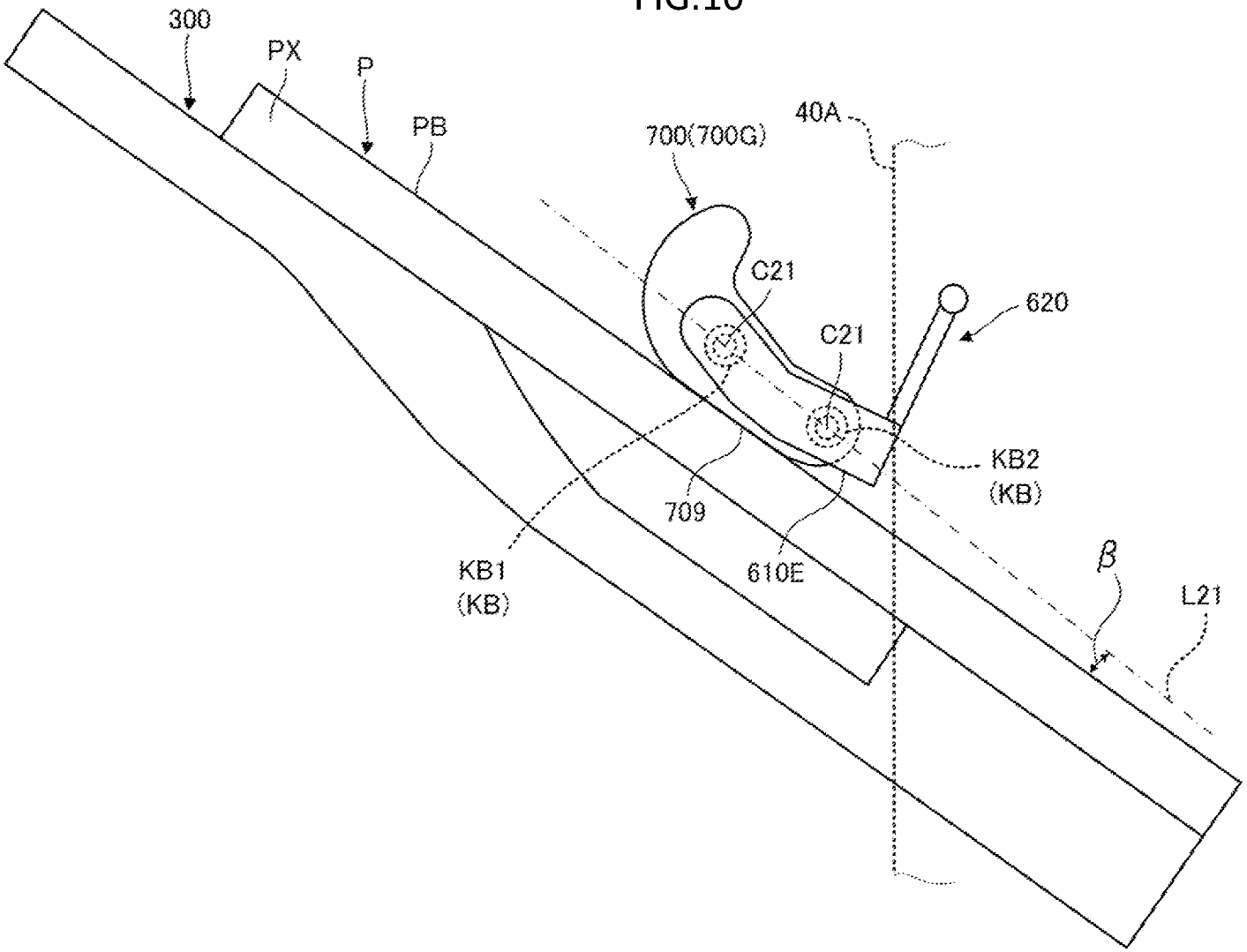
FIG. 10 is a diagram when the support portion, the sheets, the second advancing member, and the contact member are viewed from a direction indicated by an arrow X in FIG. 9.

FIG. 10 is a diagram when the support portion 300, the sheets P, the second advancing member 620, and the receiving side contact member 700G are viewed from a direction indicated by an arrow X in FIG. 9.

In the exemplary embodiment, the second advancing member 620 that is a side where the sheets P are received is disposed above the already loaded sheets PX, as described above.

Further, as described above, in the exemplary embodiment, the receiving side contact member 700G is placed on the already loaded sheets PX, and the lower edge portion 709 of the receiving side contact member 700G is in contact with the already loaded sheets PX.

Here, in the exemplary embodiment, the lower edge portion 709 is disposed along the surface of the already loaded sheets PX, and the lower edge portion 709 and the already loaded sheets PX are in line contact with each other.

Further, in the exemplary embodiment, when the lower edge portion 709 is in contact with the already loaded sheets PX, parallelism between the lower edge portion 709 and the already loaded sheets PX is higher than parallelism between the lower edge portion 610E of the second advancing member 620 and the already loaded sheets PX.

Here, in the exemplary embodiment, the first advancing member 610 that is a side where the sheets P are pushed is disposed, for example, in the state shown in FIG. 6.

Further, the second advancing member 620 that is a side where the sheets P are received is disposed in a state shown in FIG. 10. The second advancing member 620 is disposed in a state of being along the already loaded sheets PX rather than the first advancing member 610.

In other words, in the exemplary embodiment, an angle formed by a line L11 and the edge portion PB of the sheets P is an angle $\alpha$, as shown in FIG. 6. The line L11 connects central axes C2 of the tip-end-side coil spring KB1 and the base side coil spring KB2 that are provided on the first advancing member 610 side.

On the contrary, an angle formed by a line L21 and the edge portion PB of the sheets P is an angle $\beta$, as shown in FIG. 10. The line L21 connects central axes C21 of the tip-end-side coil spring KB1 and the base side coil spring KB2 that are provided on the second advancing member 620 side.

In the exemplary embodiment, the first advancing member 610 and the second advancing member 620 are arranged such that the angle α is larger than the angle β.

In the exemplary embodiment, on the second advancing member 620 (see FIG. 10) side, the coil springs KB receive a load that acts on the second advancing member 620 side from the newly supplied sheets P (not shown in FIG. 10). At this time, in the exemplary embodiment, the two coil springs KB including the tip-end-side coil spring KB1 and the base side coil spring KB2 receive the load.

On the contrary, on the first advancing member 610 (see FIG. 6) side, a load caused by a reaction from the sheets P is received by the coil springs KB. However, at this time, in the exemplary embodiment, the load is mainly received by the tip-end-side coil spring KB1.

Here, on the second advancing member 620 (see FIG. 10) side that is a receiving side, as described above, since the load is received by two coil springs KB, a load that acts on each coil spring KB is small. In this case, the receiving side contact member 700G provided on the second advancing member 620 side is difficult to move, and positioning of the sheets P by the receiving side contact member 700G is made more stable.

Further, in a configuration in which the receiving side contact member 700G is difficult to move, the already loaded sheets PX that are positioned below the receiving side contact member 700G and in contact with the receiving side contact member 700G are difficult to move.

In the exemplary embodiment, when the sheets P are pushed against the receiving side contact member 700G that functions as a receiving portion that receives the sheets P, as described above, the receiving side contact member 700G is likely to rotate around the lower edge portion 709 (see FIG. 9) in the direction indicated by the arrow 9F.

In other words, in the exemplary embodiment, the lower edge portion 709 of the receiving side contact member 700G is in contact with the already loaded sheets PX, receives a drag force from the sheets P, and is unlikely to move. On the other hand, a portion of the receiving side contact member 700G positioned above the lower edge portion 709 is pushed by the new sheets P and is likely to fall in the direction indicated by the arrow 9F.

In this case, the already loaded sheets PX positioned below the receiving side contact member 700G is unlikely to move. Then, in this case, a position shift of the already loaded sheets PX due to movement of the lower edge portion 709 of the receiving side contact member 700G is unlikely to occur.

In the exemplary embodiment, as described above, the tapered surface TM is attached to the receiving side contact member 700G. Accordingly, the receiving side contact member 700G is more likely to fall.

In other words, in the exemplary embodiment, the tapered surface TM is attached to a surface of the receiving side contact member 700G positioned on a side where the receiving side contact member 700G falls, so that the receiving side contact member 700G is more likely to fall.

On the other hand, on the first advancing member 610 (see FIG. 6) side, the load caused by the reaction from the sheets P is mainly received by the tip-end-side coil spring KB1.

In this case, a contraction amount of the tip-end-side coil spring KB1 is increased, and the pushing side contact member 700E is moved largely. In this case, a load that acts on the sheets P from the first advancing member 610 side is reduced.

Here, if a load that acts on the sheets P is large, the sheets P may be wavy and deformed, or the sheets P may bounce and alignment may be disturbed when the load is released. Further, if the load that acts on the sheets P is large, the edge portion PB of the sheets P may be broken.

On the contrary, in the exemplary embodiment, the load that acts on the sheets P is reduced, and a defect that occurs when a large load is applied to the sheets P is unlikely to occur.

Here, as described above, a variation often exists in a size of a sheet P, and a sheet P having a size larger than a specified value may exist.

In this case, the sheet P having a size larger than the specified value is excessively pushed by the pushing side contact member 700E, and in this case, the sheet P may be deformed or the sheet P may be disturbed.

On the contrary, in the exemplary embodiment, when there is the sheet P having a size larger than a specified value, the pushing side contact member 700E and the receiving side contact member 700G are retracted from the sheet P.

Accordingly, an excessive load is prevented from acting on the sheets P, and deformation of the sheets P and disturbance of the sheets P are prevented.

In the exemplary embodiment, a movement amount (an amount of retraction from the sheets P) of the pushing side contact member 700E provided on an advancing side is larger than a movement amount of the receiving side contact member 700G provided on a receiving side.

In this case, on the receiving side, the sheets P may be positioned more accurately, and on the advancing side, a load that acts from the sheets P may be released.

In the exemplary embodiment, as shown in FIG. 8, similarly, when both the first advancing member 610 and the second advancing member 620 are advanced to the paper P, the contact members 700 provided on both sides of the sheets P are retracted from the sheets P, and a load that acts on the sheets P is reduced.

In the exemplary embodiment, an accumulation unit is provided which accumulates sheets P transported from an upstream side while an alignment processing of the sheets P is performed by using the first advancing member 610 and the second advancing member 620.

More specifically, in the exemplary embodiment, during a period from advancing of the advancing member 600 being started to the advancing member 600 being returned to an original position, in which the advancing member 600 includes one or both of the first advancing member 610 and the second advancing member 620, new sheets P may be transported from the upstream side to the support portion 300. In this case, in the exemplary embodiment, the new sheets P are temporarily accumulated in the accumulation unit.

Specifically, in the exemplary embodiment, the sheet accumulation unit 60 (see FIG. 2) functions as an accumulation unit. During the period from the advancing of one or both of the advancing members 600 being started to one or both of the advancing members 600 being returned to the original position, a plurality of new sheets P are accumulated in the sheet accumulation unit 60.

In other words, in the exemplary embodiment, the plurality of sheets P, which have reached the sheet accumulation unit 60 during the period from advancing of one or both of the advancing members 600 being started to one or both of the advancing members 600 being returned to the original position, are accumulated in the sheet accumulation unit 60.

Then, in the exemplary embodiment, when the advanced advancing member(s) 600 is (are) returned to the original position, the plurality of sheets P accumulated in the sheet accumulation unit 60 are sent to the first loading unit 43.

Here, for example, in a configuration in which a plurality of sheets P are not accumulated in the sheet accumulation unit 60, it is necessary to perform a processing such as temporarily stopping an image forming processing of the image forming apparatus 2 (see FIG. 1).

More specifically, during an alignment processing of the sheets P in the first loading unit 43, transport of the sheets P toward the first loading unit 43 is delayed. Therefore, in this case, the image forming apparatus 2 is influenced by the delay and needs to perform a processing such as temporarily stopping the image forming processing.

On the contrary, as in the exemplary embodiment, when the plurality of sheets P are accumulated in the sheet accumulation unit 60, an influence on the image forming apparatus 2 is reduced, and a processing efficiency of the entire image forming system 1 may be improved as compared with a case where the accumulation is not performed.

In the above description, both of the first advancing member 610 and the second advancing member 620 have a function of pushing the sheets P and a function of receiving the sheets P. One advancing member 600 may only have the function of pushing the sheets P, and the other advancing member 600 may only have the function of receiving the sheets P.

In other words, in the above description, both of the first advancing member 610 and the second advancing member 620 have a function of advancing and retracting with respect to the sheets P. However, the present invention is not limited thereto. The function of advancing and retracting with respect to the sheets P may be only given to one advancing member 600 including one of the first advancing member 610 and the second advancing member 620, the function of advancing and retracting may not be given to the other advancing member 600, and the other advancing member 600 may be provided in a fixed state.

Further, on the side where the sheets P are received, a member such as the receiving side contact member 700G described above is not provided, but for example, a wall portion along the vertical direction may be provided, and the sheets P may push the wall portion.

Figure 13:
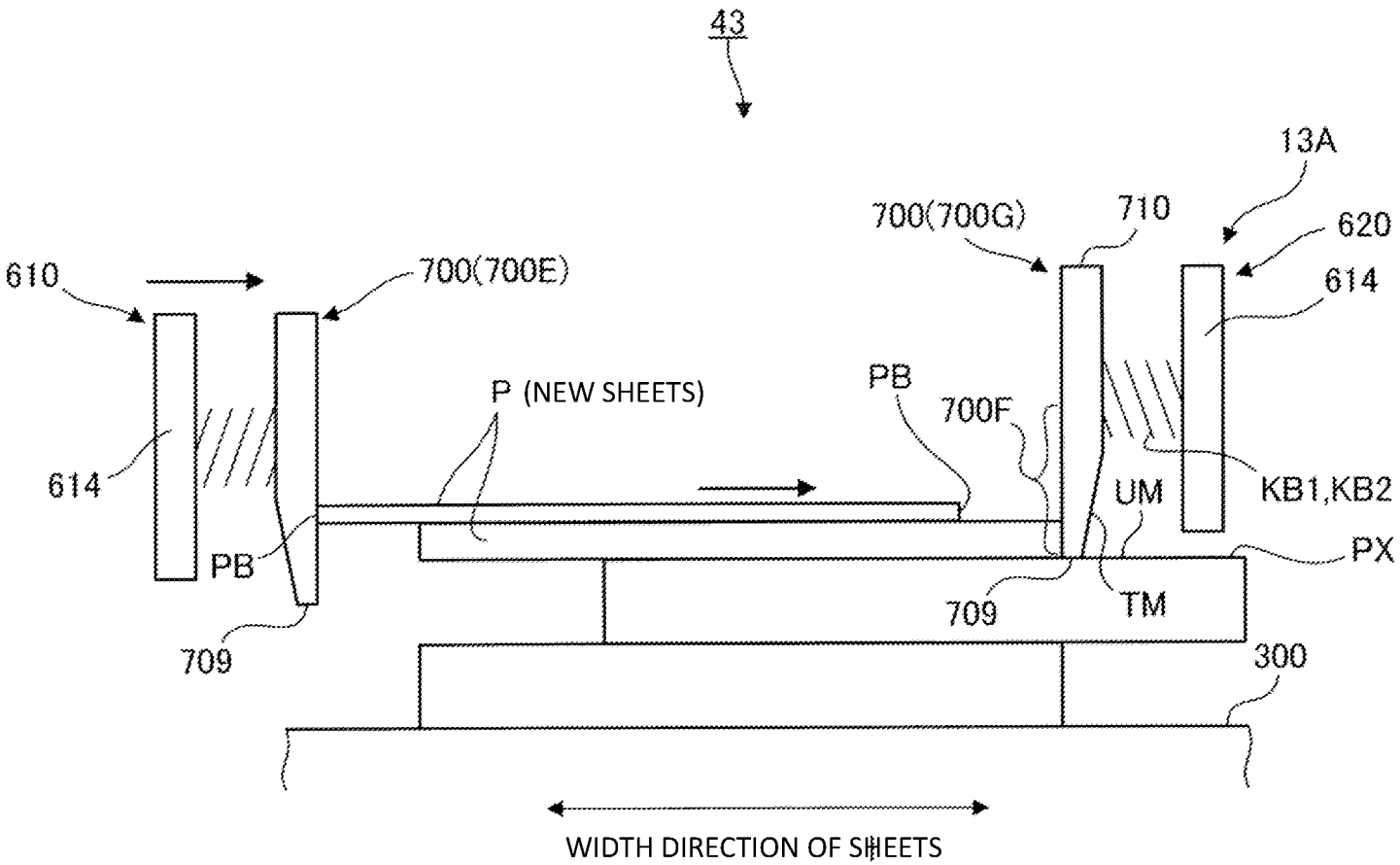
FIG. 13 is a diagram showing another example of loading sheets on the support portion.

FIG. 13 is a diagram showing another example of loading sheets P on the support portion 300.

In the loading example shown in FIG. 13, similar to the loading example shown in FIG. 9, the sheets P are offset so as to load the sheets P.

Here, in this loading example, an offset amount is larger than that in a loading mode shown in FIG. 9. In other words, a shift amount in a horizontal direction is large between a loading position of already loaded sheets PX and a loading position of the newly loaded sheets P.

In this case, as indicated by a reference numeral 13A, an advancing portion 614 positioned on a receiving side of the sheets P is disposed at a position facing an upper surface UM of the already loaded sheets PX.

In other words, when an edge portion PB of the newly loaded sheets P is pushed against the receiving side contact member 700G, the advancing portion 614 positioned on the receiving side of the sheets P is disposed at the position facing the upper surface UM of the already loaded sheets PX.

Further, the advancing portion 614 positioned on the receiving side is disposed in a state of being separated from the already loaded sheets PX. More specifically, the advancing portion 614 is positioned above the upper surface UM of the already loaded sheets PX and is disposed in a state of being separated from the upper surface UM.

Figure 14:
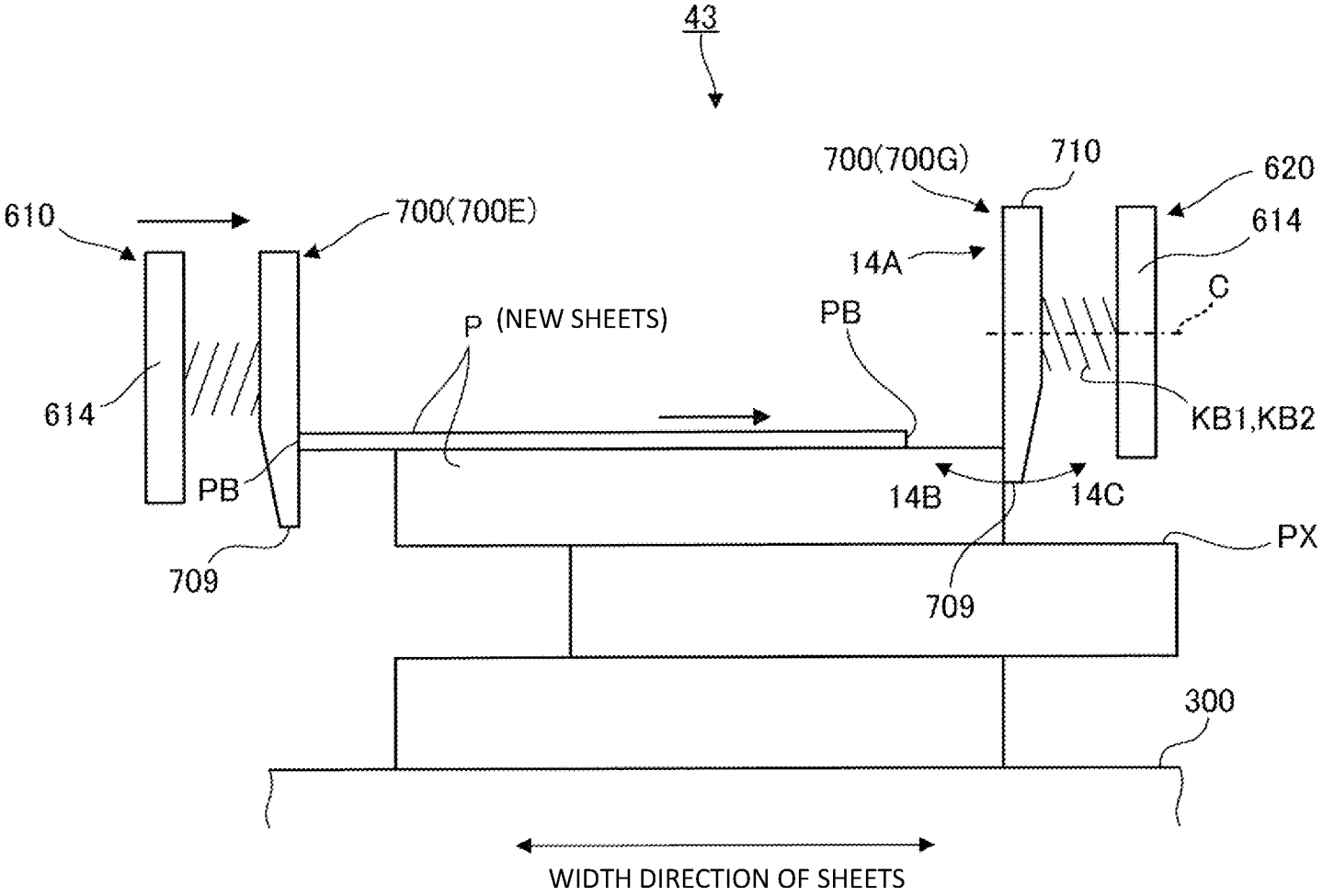
FIG. 14 is a diagram showing another example of loading sheets on the support portion.

FIG. 14 is a diagram showing another example of loading sheets P on the support portion 300.

FIG. 14 shows a state where the receiving side contact member 700G is separated from the already loaded sheets PX.

In this processing example, at an initial stage when the new sheets P are loaded on the already loaded sheets PX, the receiving side contact member 700G is disposed in a state of being in contact with the upper surface of the already loaded sheets PX in the same manner as described above.

Then, in this processing example, when the number of sheets P newly loaded on the support portion 300 is larger than a predetermined number, the support portion 300 is lowered. Accordingly, the already loaded sheets PX are also lowered, and the receiving side contact member 700G is separated from the already loaded sheets PX.

Accordingly, the sheets P may be continuously pushed against a portion of the receiving side contact member 700G positioned below a central axis C of the tip-end-side coil spring KB1 and the base side coil spring KB2.

More specifically, the sheets P may be continuously pushed against the portion of the receiving side contact member 700G positioned below the central axis C of the tip-end-side coil spring KB1 and the base side coil spring KB2 that are positioned on a right side of the figure.

Here, for example, it is assumed that the sheets P are pushed against a portion of the receiving side contact member 700G positioned above the central axis C of the tip-end-side coil spring KB1 and the base side coil spring KB2. More specifically, it is assumed that the sheets P are pushed against the portion indicated by a reference numeral 14A in FIG. 14.

In this case, a lower edge portion 709 side of the receiving side contact member 700G is moved toward a sheet P side as indicated by an arrow 14B, and loading disturbance of the sheets P occurs.

In other words, when the support portion 300 is not lowered, the sheets P may be pushed against the portion of the receiving side contact member 700G positioned above the central axis C of the tip-end-side coil spring KB1 and the base side coil spring KB2.

More specifically, as a loading amount of the sheets P increases, the sheets P are loaded further upward, and when the support portion 300 is not lowered, the sheets P may be pushed against the portion of the receiving side contact member 700G positioned above the central axis C of the tip-end-side coil spring KB1 and the base side coil spring KB2.

In this case, the lower edge portion 709 side of the receiving side contact member 700G is moved toward the sheet P side as indicated by the arrow 14B, and the loading disturbance of the sheets P occurs.

On the contrary, when the support portion 300 is lowered as in the exemplary embodiment, as described above, the sheets P may be pushed against the portion of the receiving side contact member 700G positioned below the central axis C of the tip-end-side coil spring KB1 and the base side coil spring KB2.

In this case, the loading disturbance of the sheets P caused by the lower edge portion 709 side of the receiving side contact member 700G being moved in the direction indicated by the arrow 14B is prevented.

In the loading example shown in FIG. 14, when a sheet P having a size larger than a specified value is pushed against the receiving side contact member 700G, the lower edge portion 709 of the receiving side contact member 700G is moved in a direction indicated by an arrow 14C.

More specifically, when the sheet P having a size larger than the specified value is pushed against the portion of the receiving side contact member 700G positioned below the central axis C of the tip-end-side coil spring KB1 and the base side coil spring KB2, the lower edge portion 709 is moved in the direction indicated by the arrow 14C.

Thereafter, the lower edge portion 709 is returned to an original position by an urging force that acts on the receiving side contact member 700G from the tip-end-side coil spring KB1 and the base side coil spring KB2. In other words, the lower edge portion 709 moved in the direction indicated by the arrow 14C is moved in a left direction of the figure. Accordingly, the sheets P are stopped at a predetermined loading position.

In the processing example shown in FIG. 14, the support portion 300 is lowered, but the present invention is not limited thereto. The receiving side contact member 700G may be raised. Further, both the lowering of the support portion 300 and the raising of the receiving side contact member 700G may be performed.

Figure 15:
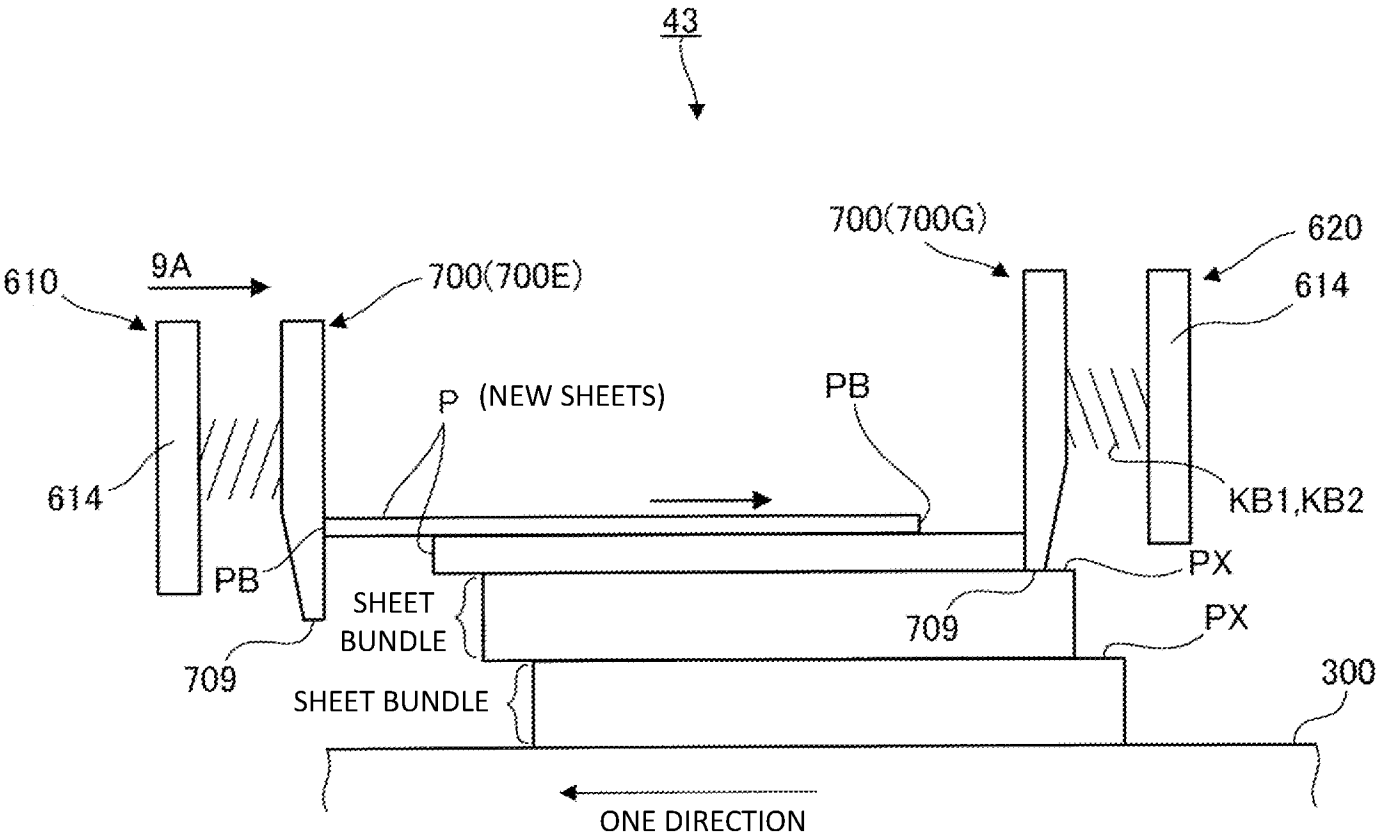
FIG. 15 is a diagram showing another example of loading sheets on the support portion.
Figure 16:
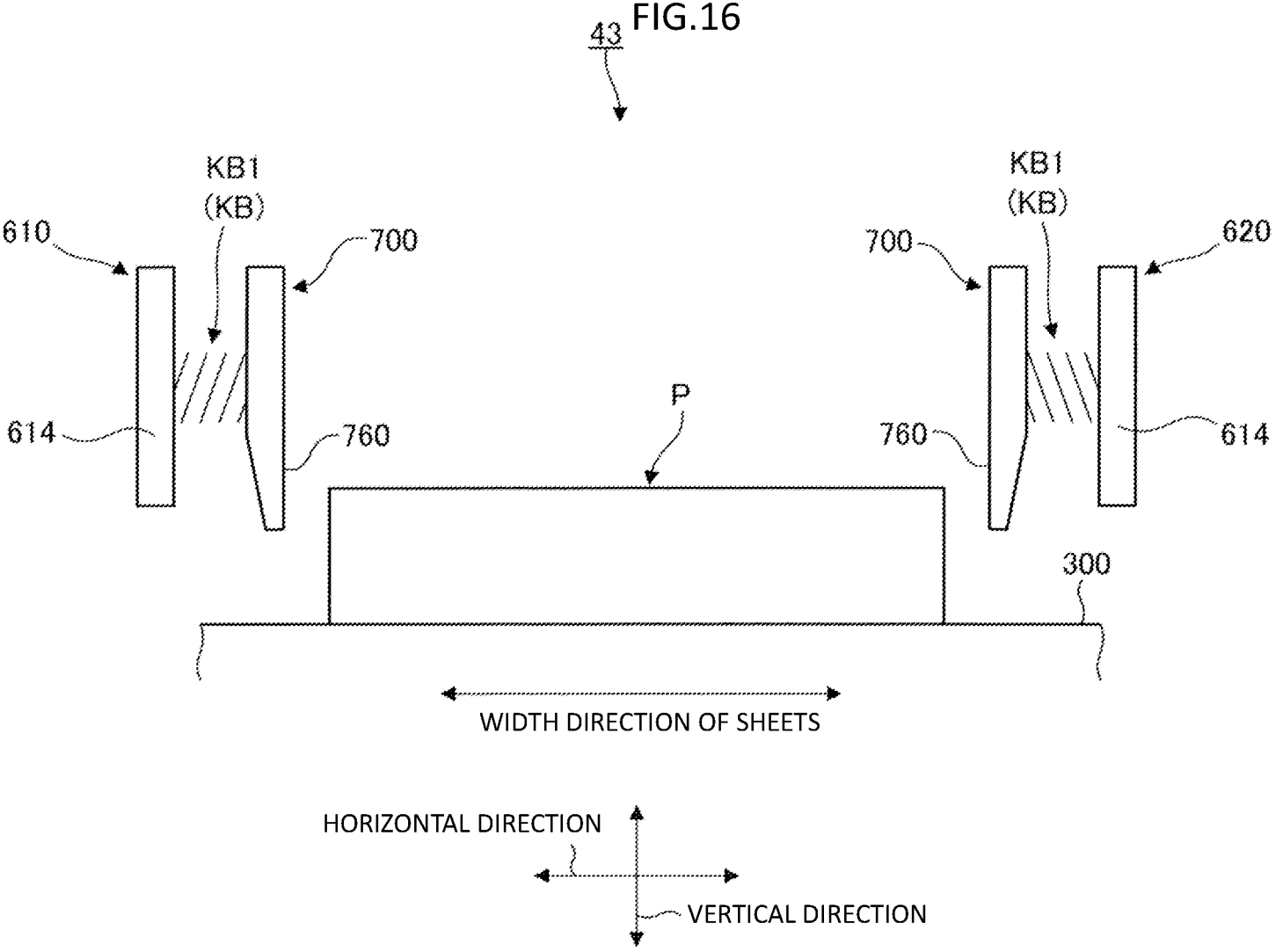
FIG. 16 is a diagram showing a state of the contact member and the like retracted from sheets.

FIG. 15 is a diagram showing another example of loading sheets P on the support portion 300.

FIG. 15 shows a mode in which a loading position of a new sheet P is shifted in one direction each time a new sheet P is loaded. More specifically, a mode is shown in which the loading position is shifted in a left direction of the figure.

More specifically, in this loading mode, the sheets P are loaded for each sheet bundle. Each time a new sheet bundle is generated, a loading position of the new sheet bundle is shifted, and the loading position is shifted to a downstream side in one direction.

More specifically, in this loading mode, when the sheets P newly loaded on the support portion 300 are loaded on already loaded sheets PX already loaded on the support portion 300, the newly loaded sheets P become already loaded sheets PX. Thereafter, new sheets P are further loaded on the already loaded sheets PX.

In this loading mode, each time new sheets P are loaded, a loading position of the new sheets P is sequentially shifted, and the loading position is sequentially shifted to the downstream side in one direction.

As a result, in the exemplary embodiment, as shown in FIG. 15, the sheets P are loaded in a stepped shape.

In FIG. 15, there are coil springs on both the pushing side contact member 700E and the receiving side contact member 700G, but only the receiving side contact member 700G may be supported by coil springs, and coil springs of the pushing side contact member 700E may be deleted.

Figure 11A:
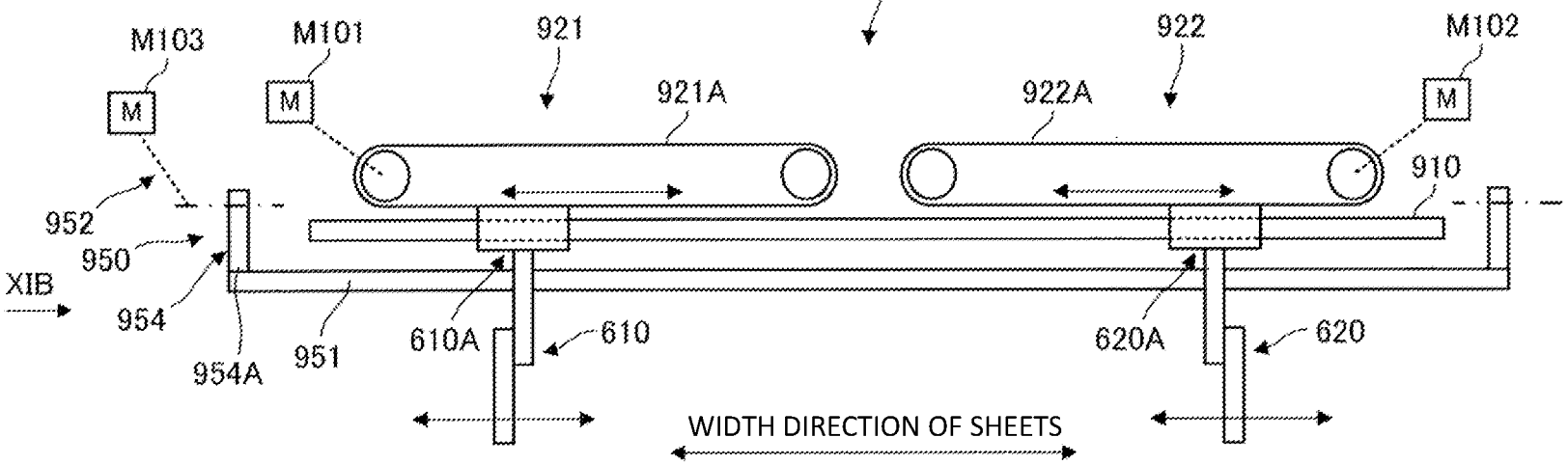
FIG. 11A is a view illustrating a movement mechanism.
Figure 11B:
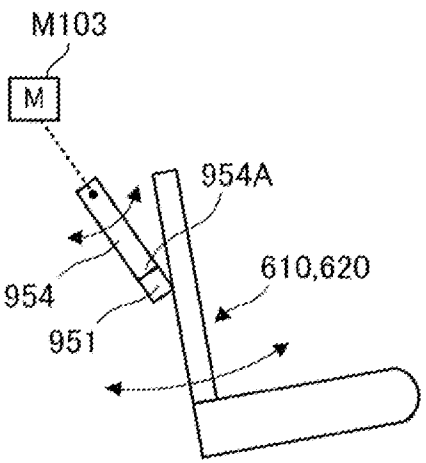
FIG. 11B is a view illustrating a movement mechanism.

FIGS. 11A and 11B are views illustrating the movement mechanism 730 (see FIG. 4).

FIG. 11A is a top view of the movement mechanism 730. FIG. 11B is a view when a part of the movement mechanism 730 is viewed from a direction of an arrow XIB in FIG. 11A.

In the exemplary embodiment, as described above, the movement mechanism 730 that moves the first advancing member 610 and the second advancing member 620 is provided.

As shown in FIG. 11A, the movement mechanism 730 is provided with a guide member 910 that is disposed along an advancing and retracting direction of the first advancing member 610 and the second advancing member 620 and guides the first advancing member 610 and the second advancing member 620.

In the exemplary embodiment, a first movement mechanism 921 that moves the first advancing member 610 is provided. Further, a second movement mechanism 922 that moves the second advancing member 620 is provided.

The first movement mechanism 921 is provided with an annular belt member 921A including a portion along the advancing and retracting direction of the first advancing member 610. Further, a first drive motor M101 that moves the belt member 921A is provided.

In the exemplary embodiment, the first advancing member 610 is fixed to the belt member 921A. In the exemplary embodiment, the first advancing member 610 is advanced or retracted along a width direction of the sheets P by driving the first drive motor M101.

Similarly, the second movement mechanism 922 is also provided with an annular belt member 922A including a portion along the advancing and retracting direction of the second advancing member 620, and a second drive motor M102 that moves the belt member 922A. The second advancing member 620 is advanced or retracted along the width direction of the sheets P by driving the second drive motor M102.

In the exemplary embodiment, as shown in FIG. 11A, a rotation mechanism 950 is provided.

The rotation mechanism 950 rotates the first advancing member 610 around a base 610A of the first advancing member 610, and rotates the second advancing member 620 around a base 620A of the second advancing member 620.

The rotation mechanism 950 is provided with a support member 951 that extends along the advancing and retracting direction of the first advancing member 610 and the second advancing member 620 and supports the first advancing member 610 and the second advancing member 620 from below.

Further, the rotation mechanism 950 is provided with an upper-and-lower movement mechanism 952 that moves the support member 951 in an upper and lower direction.

The upper-and-lower movement mechanism 952 is provided with a third drive motor M103. Further, the upper-and-lower movement mechanism 952 is provided with a rotation member 954 that is rotated by the third drive motor M103 and moves one end 954A in the upper and lower direction. In the exemplary embodiment, the support member 951 is attached to one end 954A of the rotation member 954.

In the exemplary embodiment, when the third drive motor M103 is driven to rotate the rotation member 954 as shown in FIG. 11B, the support member 951 is moved in the upper and lower direction, and accordingly, the first advancing member 610 and the second advancing member 620 are moved in the upper and lower direction.

Here, in the exemplary embodiment, as shown in FIG. 8, when the sheets P are pushed from both sides of the sheets P by using the first advancing member 610 and the second advancing member 620, the third drive motor M103 is driven to lower the first advancing member 610 and the second advancing member 620 to sides of the sheets P supported by the support portion 300.

Next, in the exemplary embodiment, the first drive motor M101 and the second drive motor M102 are driven so as to move the first advancing member 610 and the second advancing member 620 toward the sheets P.

In order to arrange the first advancing member 610 and the second advancing member 620 as shown in FIG. 9, similarly, the third drive motor M103 is driven. Accordingly, the first advancing member 610 is lowered to a side of the sheets P supported by the support portion 300.

Further, in the exemplary embodiment, while the first advancing member 610 is lowered, movement of the second advancing member 620 is regulated by the already loaded sheets PX, and the second advancing member 620 is positioned above the already loaded sheets PX.

Then, the first drive motor M101 is driven so as to advance the first advancing member 610 toward the sheets P.

Second Exemplary Embodiment

Hereinafter, a second exemplary embodiment of the present invention will be described in detail with reference to the accompanying drawings. A description of the same configuration as that of the first exemplary embodiment will be omitted.

Figure 17:
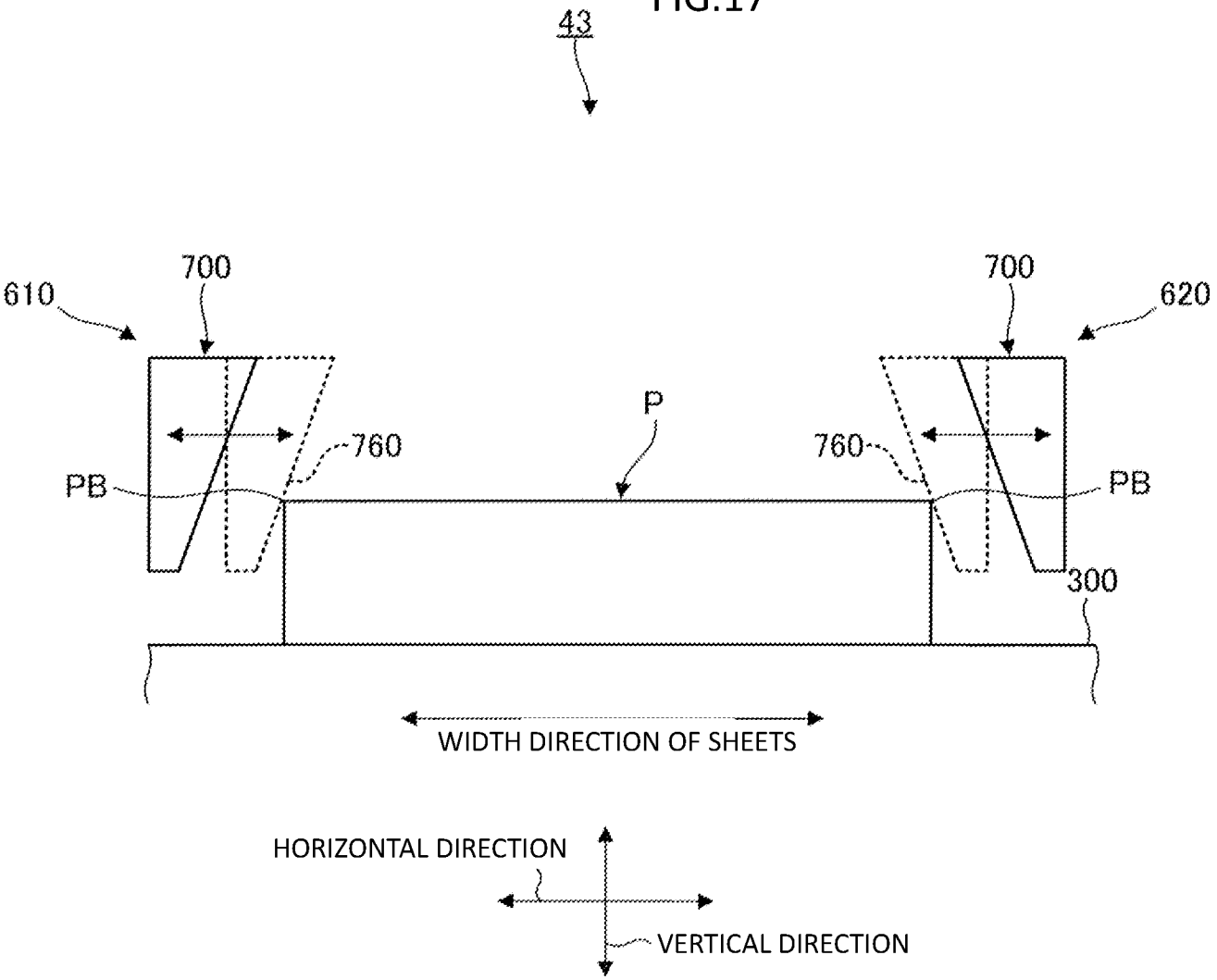
FIG. 17 is a diagram showing another configuration example.

FIG. 17 is a diagram showing another configuration example.

In this configuration example, even when not being in contact with sheets P, a contact surface 760 of each contact member 700 faces obliquely downward. In other words, in this configuration example, even when the contact member 700 is retracted from the sheets P, the contact surface 760 of the contact member 700 faces obliquely downward.

In other words, in this configuration example, a portion of the contact member 700 that is in contact with an edge portion PB of the sheets P is provided with an inclined surface that is inclined with respect to a vertical direction and faces obliquely downward.

More specifically, in this configuration example shown in FIG. 17, an inclination is given to an entire surface of the contact member 700 that faces a sheet P side. The entire surface is inclined with respect to the vertical direction and faces obliquely downward.

Further, in this configuration example, the advancing portion 614 and the coil springs KB are not provided. The contact member 700 is directly supported by the arm portion 613 provided on the first advancing member 610 (see FIG. 5).

Also, in this configuration example, by pushing the contact surface 760 against the edge portion PB of the sheets P, positions of the sheets P in an extending direction are aligned, and a load that pushes the sheets P from above acts on the sheets P.

Figure 18:
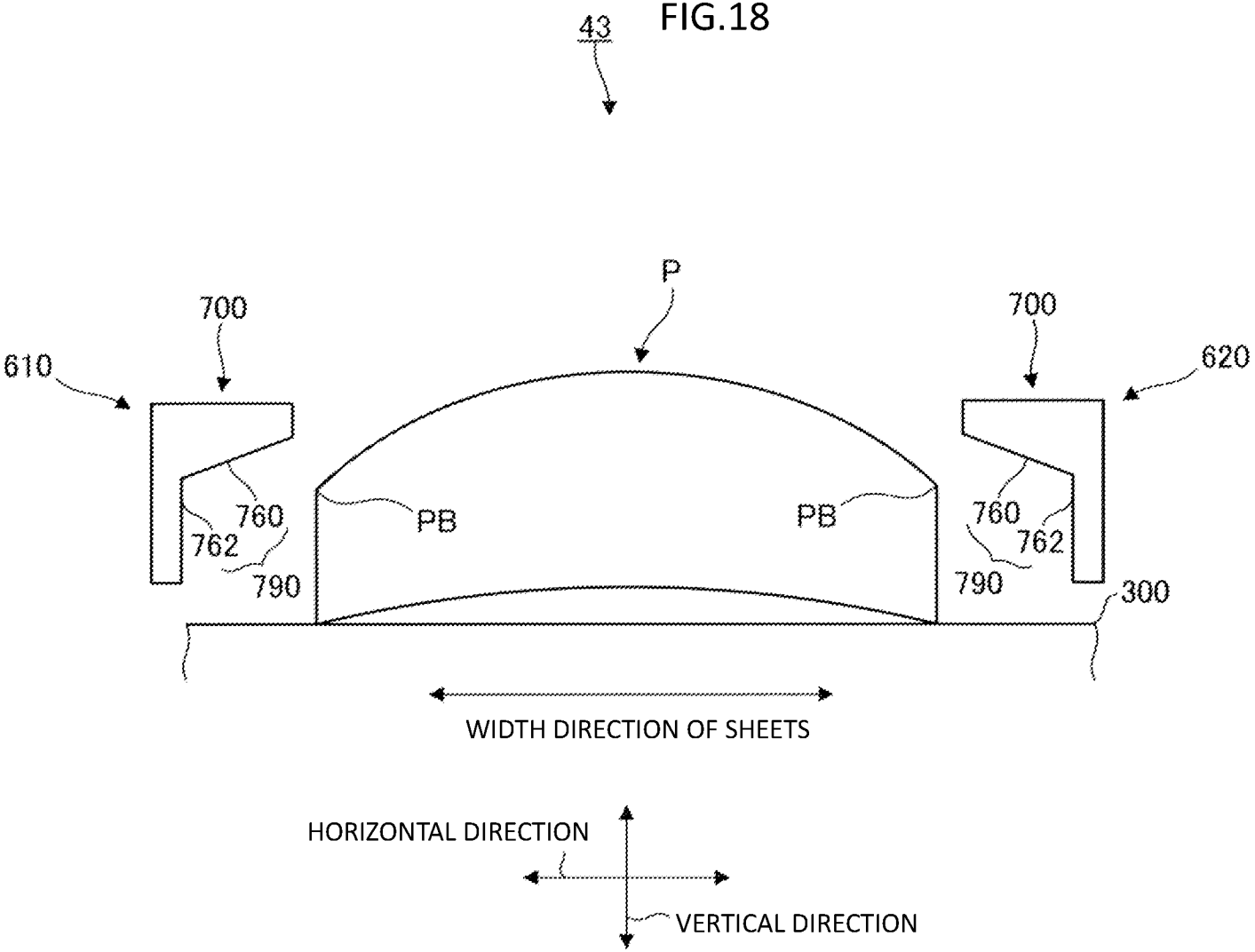
FIG. 18 is a diagram showing another configuration example of a contact member.
Figure 19:
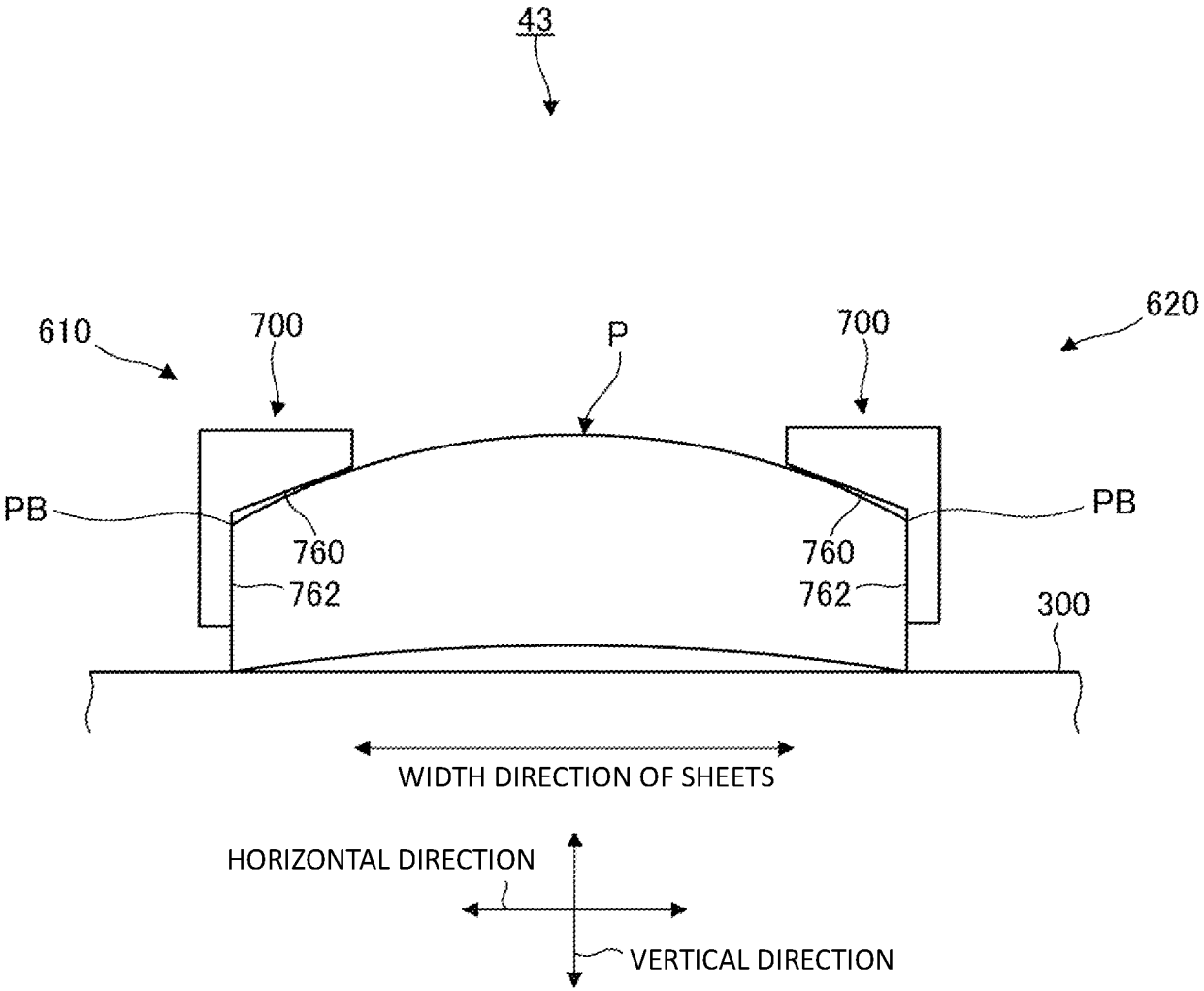
FIG. 19 is a diagram showing another configuration example of the contact member.

FIGS. 18 and 19 are diagrams showing another configuration example of contact members 700.

In this configuration example, as shown in FIG. 18, a surface 790 of a contact member 700 that faces a sheet P side is provided with a contact surface 760 that faces obliquely downward in the same manner as described above. In other words, the surface 790 of the contact member 700 that faces the sheet P side is provided with an inclined surface that faces obliquely downward.

Further, the surface 790 that faces the sheet P side is provided with a vertical surface 762 that is a surface disposed along a vertical direction.

In this configuration example, bulging of the sheets P is easily prevented.

In this configuration example, as shown in FIG. 19, the vertical surface 762 of the contact member 700 is pushed against an edge portion PB of the sheets P. Accordingly, the sheets P are aligned in the same manner as described above.

Further, in this configuration example, for example, as shown in FIG. 18, when the sheets P are curled and the sheets P bulge upward to be convex, the bulging is pushed from above by contact surfaces 760 as shown in FIG. 19. Accordingly, in this case, the bulging of the sheets P is reduced, and loading disturbance and the like of the sheets P are unlikely to occur.

The contact member 700 shown in FIGS. 18 and 19 may be directly attached to the arm portion 613 provided on the first advancing member 610 (see FIG. 5). Further, in the same manner as described above, the coil springs KB and the advancing portion 614 may be provided. The contact member 700 may be attached to the advancing portion 614 via the coil springs KB.

Next, a processing example when sheets P are loaded alternately will be described.

In the exemplary embodiment, a second advancing member 620 side functions as a receiving portion. In the exemplary embodiment, the second advancing member 620 side receives the sheets P that move as the first advancing member 610 is advanced.

More specifically, a contact member 700 attached to the second advancing member 620 receives the sheets P.

More specifically, in the exemplary embodiment, an edge portion PB of the moving sheets P is in contact with the contact member 700, so that the movement of the sheets P is regulated, and the sheets P are stopped at a predetermined position.

At this time, in the exemplary embodiment, the contact member 700 is supported by a tip-end-side coil spring KB1 and a base side coil spring KB2 that are arranged between the contact member 700 and the second advancing member 620.

In the exemplary embodiment, when the contact member 700 provided on the second advancing member 620 side is in contact with already loaded sheets PX, a lower edge portion 709 of the contact member 700 is in contact with the already loaded sheets PX.

Here, although the description is omitted in the above, in the exemplary embodiment, a thickness D1 of the lower edge portion 709 of the contact member 700 is smaller than a thickness D2 of an upper edge portion 710 of the contact member 700.

More specifically, the contact member 700 of the exemplary embodiment is formed in a plate shape and disposed along a transport direction of the sheets P.

In the exemplary embodiment, a tapered surface TM is provided at a location of the contact member 700 that is not in contact with the base side coil spring KB2 and the tip-end-side coil spring KB1.

Here, a variation often exists in a size of a sheet P, and a sheet P having a size larger than a specified value may exist.

In this case, the sheet P having a size larger than the specified value is excessively pushed by the first advancing member 610 and the second advancing member 620, and in this case, the sheet P may be deformed or the sheet P may be disturbed.

On the contrary, in the exemplary embodiment, when there is the sheet P having a size larger than the specified value, contact members 700 are retracted from the sheet P.

In other words, when there is the sheet P having a size larger than the specified value, the contact members 700 are respectively moved in a direction opposite to an advancing direction of the first advancing member 610 and a direction opposite to an advancing direction of the second advancing member 620.

Accordingly, an excessive load is prevented from acting on the sheets P, and deformation of the sheets P and disturbance of the sheets P are prevented.

When both of the first advancing member 610 and the second advancing member 620 are advanced to the sheets P, the tip-end-side coil spring KB1 mainly receives a load caused by a reaction from the sheets P.

In this case, the contact members 700 are largely moved, so that a load that acts on the sheets P from the first advancing member 610 and the second advancing member 620 is reduced.

The processing of offsetting and loading the sheets P may be performed using the configuration shown in FIG. 18.

When the configuration shown in FIG. 18 is used, in the same manner as described above, for example, as shown in FIG. 20 (diagram showing a state where the sheets P are offset and loaded in the first exemplary embodiment), a contact member 700 on a side where the sheets P are pushed (contact member 700 indicated by a reference numeral 17A) is lowered below a contact member 700 on a side where the sheets P are received (contact member 700 indicated by a reference numeral 17B).

Then, while the sheets P are pushed, a contact surface 760 of a contact member 700 on a side where the sheets P are pushed is advanced toward the sheets P, and the contact surface 760 is in contact with an edge portion PB of the sheets P. In other words, an inclined surface of the contact member 700 on the side where the sheets P are pushed is advanced toward the sheets P, and the inclined surface is in contact with the edge portion PB of the sheets P.

On the contrary, in a contact member 700 on a side where the sheets P are received, the contact member 700 is positioned such that a vertical surface 762 is positioned on an extension line of the moving sheets P. Accordingly, the edge portion PB of the sheets is pushed against the vertical surface 762.

Figure 20:
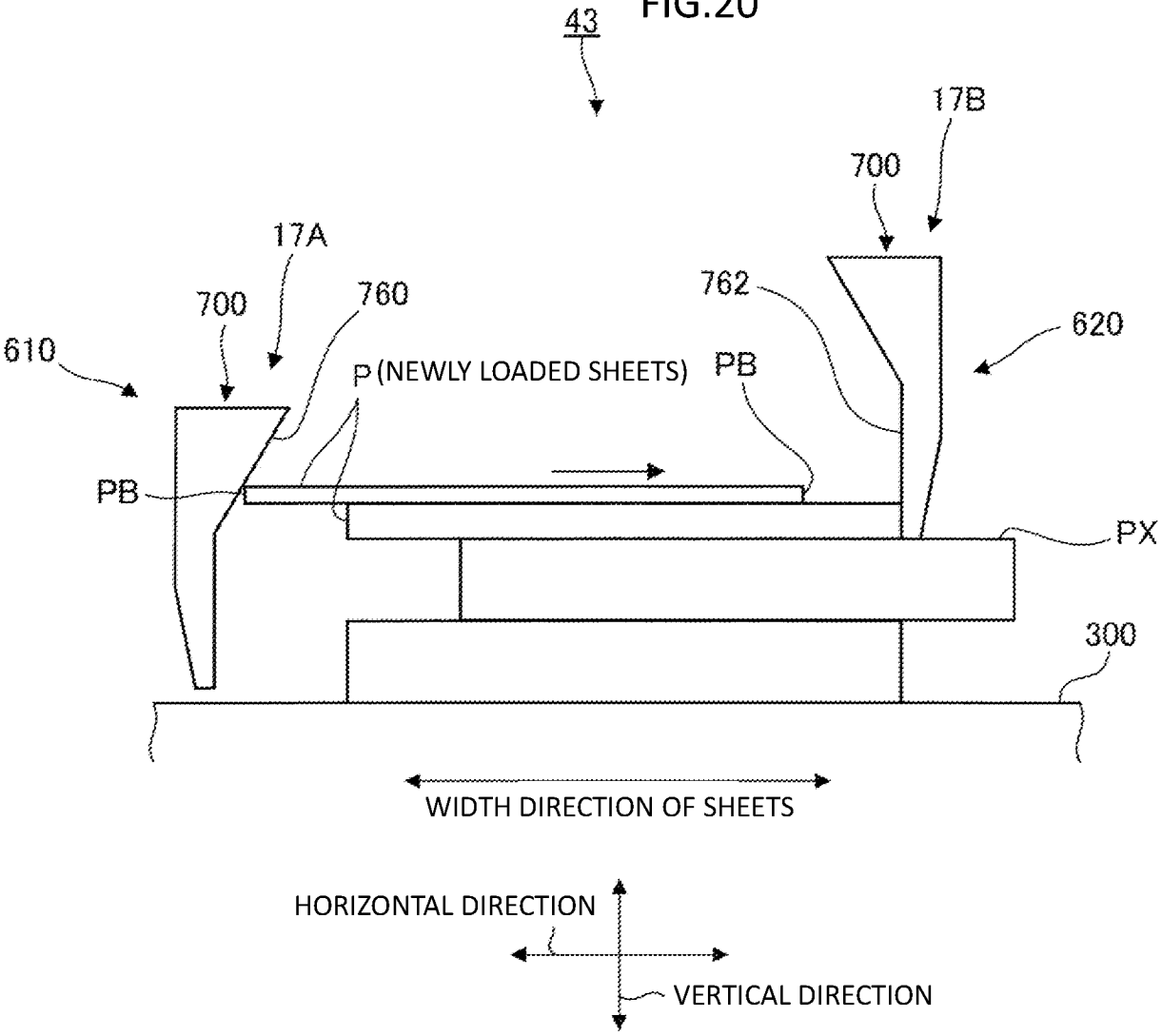
FIG. 20 is a diagram showing a state where the sheets P are offset and loaded.

An inclination angle of the contact surface 760 with respect to a vertical direction in FIG. 20 is smaller than an inclination angle of the contact surface 760 with respect to a vertical direction shown in FIG. 18.

In this processing example, a surface against which the edge portion PB of the sheets is pushed is along the vertical direction. Accordingly, positions of the sheetsP in an extending direction are aligned.

In other words, the vertical surface 762 of the contact member 700 provided on a right side of the figure is along a vertical direction. The sheets P are pushed against the vertical surface 762, so that positions of the sheets P in an extending direction are aligned. In other words, positions of the sheets P in a horizontal direction are aligned.

In this configuration example, when contact surfaces 760 that face obliquely downward are positioned at positions facing an upper surface of the newly loaded sheets P and the newly loaded sheets P bulge upward to be convex, the bulging may be prevented in the same manner as described above.

Further, in this configuration example, in the same manner as described above, the newly loaded sheets P are pushed from above by the contact surfaces 760, and a load that pushes the sheets P downward acts on the newly loaded sheets P.

Since an advancing member 600 provided in a fixed state does not have a function of advancing, the advancing member 600 cannot be regarded as an advancing member, but as an arrangement member disposed on a downstream side with respect to the sheets P that move in a width direction.

In other words, the advancing member 600 provided in a fixed state may be regarded as an arrangement member disposed on a downstream side in a sheet movement direction with respect to the sheets P pushed and moved by the other advancing member 600.

In other words, in this case, an advancing member 600 positioned on a side where the sheets P are pushed may be regarded as a movement unit that moves the sheets P supported by the support portion 300 in a width direction of the sheets P.

Further, the advancing member 600 provided in a fixed state may be regarded as an arrangement member disposed on the downstream side in the sheet movement direction with respect to the sheets P moved by the movement unit.

In this case, on an arrangement member side, the contact member 700 provided on the arrangement member side is used to receive the sheets P moved by the movement unit.

Here, in this case, the contact member 700 is disposed between the sheets P moved by the movement unit and the arrangement member.

Further, on the side where the sheets P are received, a member such as the contact member 700 may not be provided, and for example, a wall portion along a vertical direction may be provided and the sheets P may push the wall portion.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A recording material processing apparatus comprising:

a recording material support portion which is vertically movable and is configured to support a recording material loaded thereon from below;

a contact member which is vertically movable and is disposed on a side of the recording material loaded on the recording material support portion and configured to be pushed by an edge portion of the recording material, the contact member being configured to move to a side opposite to the side of the recording material;

an elastic member configured to receive a load from the contact member pushed by the edge portion of the recording material; and a member support portion disposed without contacting the recording material loaded on the recording material support portion and configured to support the contact member, wherein the member support portion is disposed at a position facing an upper surface of an already loaded recording material that is already loaded on the recording material support portion, when an edge portion of a new recording material loaded on the recording material support portion pushes the contact member, and wherein a thickness of a lower edge portion of the contact member is smaller than a thickness of an upper edge portion of the contact member.

2. The recording material processing apparatus according to claim 1, wherein the member support portion is disposed on a side opposite to the recording material loaded on the recording material support portion with respect to the contact member, and wherein the elastic member is provided between the contact member and the member support portion.

3. The recording material processing apparatus according to claim 2, wherein the elastic member comprises a plurality of elastic members arranged at positions different from each other in an extending direction of the edge portion of the recording material loaded on the recording material support portion.

4. The recording material processing apparatus according to claim 1, wherein the member support portion is disposed over the upper surface of the already loaded recording material, the member support portion being separated from the upper surface.

5. The recording material processing apparatus according to claim 1, wherein the contact member comprises a pushed surface that is pushed by the edge portion of the recording material loaded on the recording material support portion, and an opposite surface positioned on a side opposite to the pushed surface, the opposite surface comprising an inclined surface that is inclined with respect to a vertical direction and gradually increases in a distance from the pushed surface as the inclined surface goes upward.

6. The recording material processing apparatus according to claim 5, wherein the inclined surface extends upward from the lower edge portion of the contact member serving as a starting point.

7. The recording material processing apparatus according to claim 1, wherein the contact member and the member support portion are arranged along a direction in which the edge portion of the recording material loaded on the recording material support portion extends, and wherein a thickness of the contact member is different from a thickness of the member support portion when thicknesses in a direction intersecting a direction in which the edge portion extends are compared.

8. The recording material processing apparatus according to claim 7, wherein a thickness of the contact member is smaller than a thickness of the member support portion.

9. The recording material processing apparatus according to claim 1, wherein when a new recording material set comprising one or more recording materials is loaded on a loading position on an already loaded recording material set already loaded on the recording material support portion, the new recording material set newly loaded on the loading position of the already loaded recording material set becomes an other already loaded recording material set, and then another new recording material set is further loaded on a loading position of the other already loaded recording material set, and wherein the loading position is sequentially shifted in one direction when each new recording material set is loaded.

10. An image forming system comprising:

an image forming apparatus configured to form an image on a recording material; and a recording material processing apparatus configured to process a recording material, wherein the recording material processing apparatus includes the recording material processing apparatus according to claim 1.

11. An image forming system comprising:

an image forming apparatus configured to form an image on a recording material; and a recording material processing apparatus configured to process a recording material, wherein the recording material processing apparatus comprises:

a support portion configured to support, from below, a recording material discharged to the support portion after being transported from the image forming apparatus; and a contact member including a contact surface that advances to a recording material from a side of the recording material supported by the support portion and is in contact with an edge portion of the recording material, wherein the contact member is vertically movable with respect to the support portion, and wherein the contact surface faces obliquely downward when the contact surface is in contact with the edge portion and pushes the edge portion.

12. The recording material processing apparatus according to claim 11, further comprising:

an advancing portion configured to advance to the recording material together with the contact member, the advancing portion being provided on a side opposite to a side of the recording material with respect to the contact member, and an elastic member provided between the contact member and the advancing portion.

13. The recording material processing apparatus according to claim 12, wherein the elastic member is a coil spring, and wherein the contact member has a portion positioned below a central axis of the coil spring, the portion being configured to contact with the edge portion of a recording material.

14. The recording material processing apparatus according to claim 11, further comprising:

an advancing portion configured to advance to the recording material together with the contact member, the advancing portion being provided on a side opposite to a side of the recording material with respect to the contact member, wherein the contact member is supported by the advancing portion, wherein the contact member is disposed in a state of being inclined with respect to a vertical direction when the contact surface is in contact with the edge portion and pushes the edge portion, and wherein the advancing portion is disposed in a state of being along a vertical direction when the contact surface is in contact with the edge portion and pushes the edge portion.

15. The recording material processing apparatus according to claim 11, further comprising:

an advancing portion configured to advance to the recording material together with the contact member, the advancing portion being provided on a side opposite to a side of the recording material with respect to the contact member, wherein the contact member is supported by the advancing portion, wherein the contact member changes a posture when the contact member is advanced toward the recording material and is in contact with the edge portion, and the contact surface faces obliquely downward with the change of the posture, and wherein the advancing portion does not change a posture even after the contact surface of the contact member is in contact with the edge portion.

16. The recording material processing apparatus according to claim 15, wherein the advancing portion is disposed along a vertical direction, and wherein the posture of the advancing portion is not changed even after the contact surface of the contact member is in contact with the edge portion, and the advancing portion is maintained in a state of being along a vertical direction.

17. The recording material processing apparatus according to claim 11, further comprising:

an advancing portion configured to advance to the recording material together with the contact member, the advancing portion being provided on a side opposite to a side of the recording material with respect to the contact member, wherein the contact member is supported by the advancing portion, and wherein a thickness of the contact member is smaller than a thickness of the advancing portion in a case where thicknesses in an advancing direction when the contact member is advanced toward the recording material are compared.

18. The recording material processing apparatus according to claim 11, wherein the contact surface is disposed along a vertical direction when the contact member is retracted from the recording material.

* * * * *